US005363520A

United States Patent [19]

Lyne, Jr.

[11] Patent Number: 5,363,520

[45] Date of Patent: Nov. 15, 1994

[54] SPACE-SAVING BED

[76] Inventor: Robert C. Lyne, Jr., 10207 Maremont Cir., Richmond, Va. 23233

[21] Appl. No.: 852,410

[22] Filed: Mar. 16, 1992

Related U.S. Application Data

[63] Continuation-in-part of Ser. No. 579,798, Sep. 10, 1990, abandoned.

[51] Int. Cl.[5] ..... A47C 17/00

[52] U.S. Cl. ..... 5/11; 5/10.2

[58] Field of Search ..... 5/1, 2.1, 9.1, 10.1, 5/10.2, 11, 611

[56] References Cited

U.S. PATENT DOCUMENTS

| | | | |
|---|---|---|---|
| 556,404 | 3/1896 | Deihm | 5/10.1 |
| 561,654 | 6/1986 | Cole | 5/10.2 |
| 931,962 | 8/1909 | Rountree | 5/10.2 |
| 980,171 | 12/1910 | Palmer | 5/10.2 |
| 1,696,412 | 12/1928 | Price | 5/10.2 |
| 1,991,848 | 2/1935 | Embree . | |
| 2,869,143 | 1/1959 | Eder | 5/9.1 |
| 3,665,527 | 5/1972 | Gonzalez | 5/10.2 |
| 3,882,554 | 5/1975 | Glass | 5/10.1 |

FOREIGN PATENT DOCUMENTS

| | | | |
|---|---|---|---|
| 3830980 | 3/1990 | Germany | 5/10.1 |
| 2979 | of 1866 | United Kingdom | 5/10.1 |

OTHER PUBLICATIONS

Collegiate Designs Inc. Furniture.

*Primary Examiner*—Flemming Saether

[57] ABSTRACT

A free-standing, self-supporting bed has a movable platform supported by a stationary frame. The platform may be elevated vertically to a stored position higher than head height when the bed is not in use. Counterweights allow the platform to be elevated and lowered with a minimum of effort. In the stored position the platform is suspended from the frame by redundant lines passing over pulleys. In the sleeping position the counterweights are suspended from the frame and the platform rests on the frame and may be secured thereto by latching devices operable from one side of the bed. The lines and pulleys are arranged so that the counterweights have a 2:1 mechanical advantage with respect to the platform and so that, during raising or lowering of the platform, forces keeping the ends of the platform horizontal are automatically exerted thereon.

26 Claims, 17 Drawing Sheets

FIG. 6
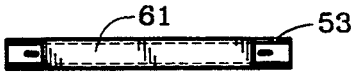
FIG. 7
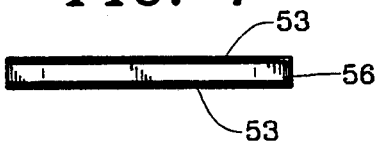
FIG. 9
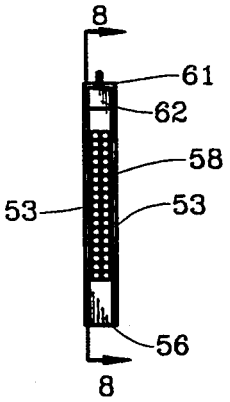
FIG. 8
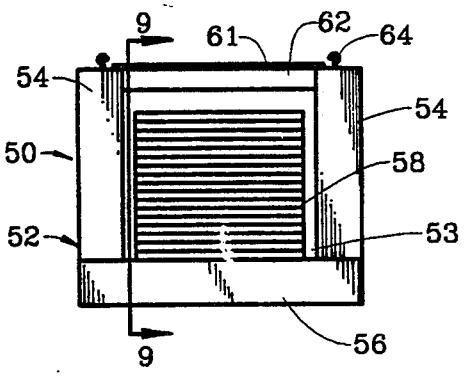
FIG. 10
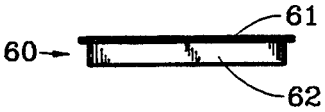
FIG. 11
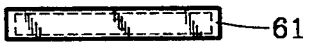
FIG. 12
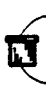
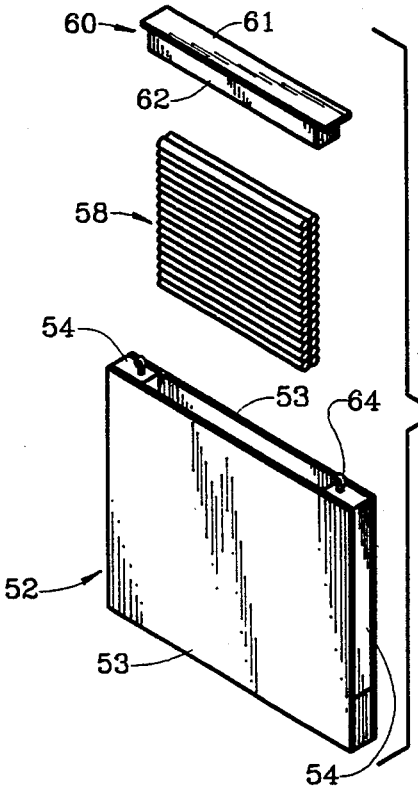
FIG. 12A

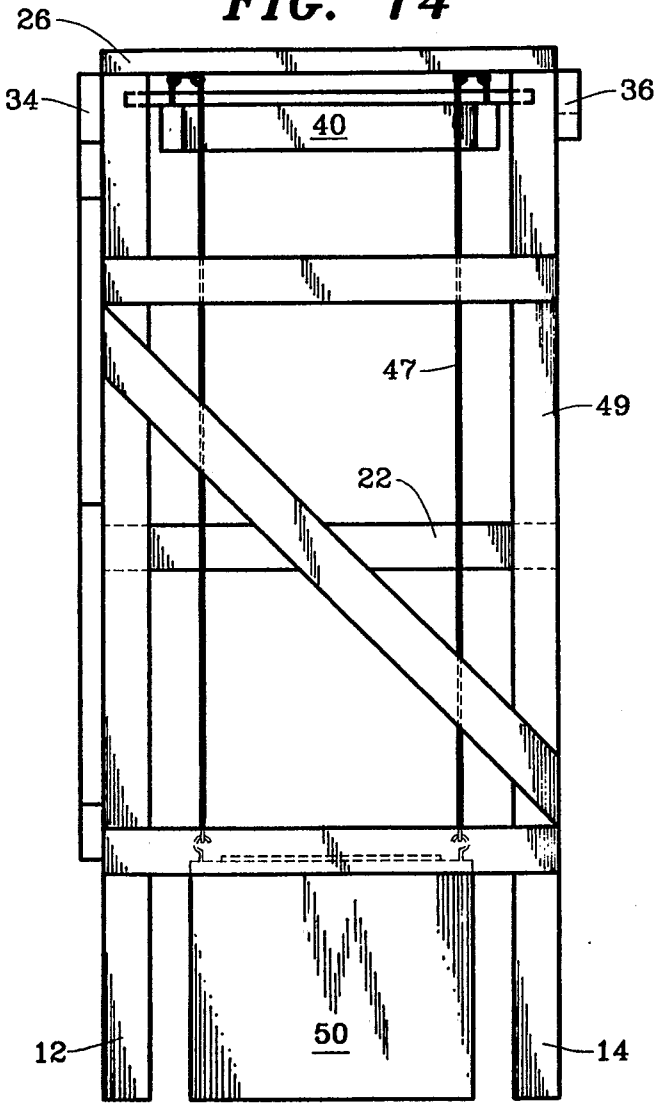
FIG. 14
FIG. 13
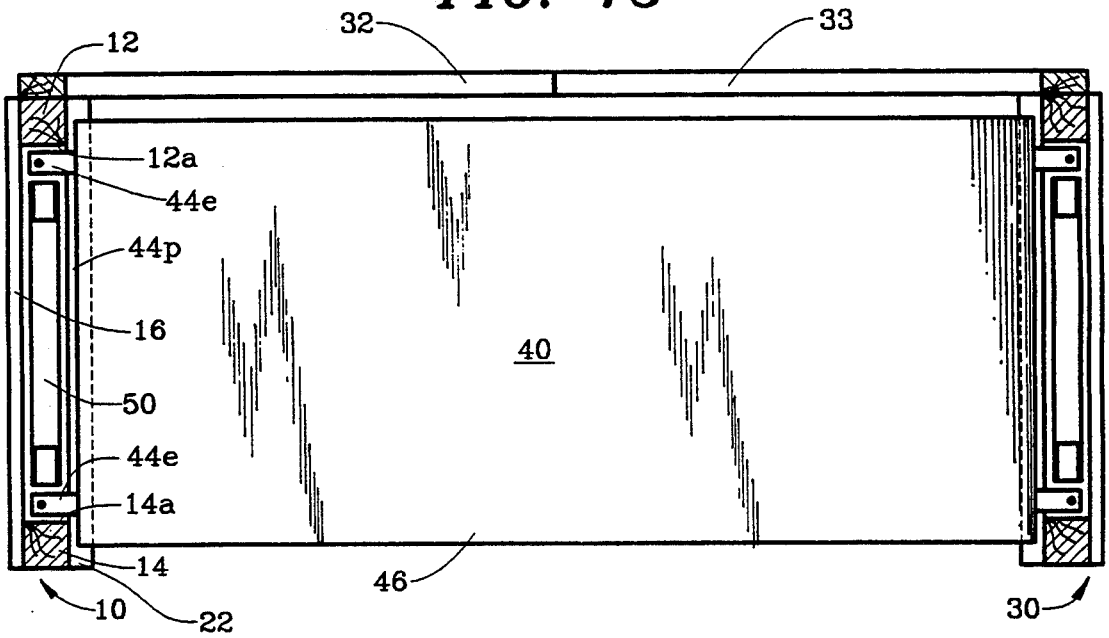

SPACE-SAVING BED

CROSS REFERENCE TO RELATED APPLICATION

This application is a continuation-in-part of my copending patent application Ser. No. 07/579,798 filed Sep. 10, 1990, now abandoned.

BACKGROUND OF THE INVENTION

In many living environments beds take up an inordinate amount of space. Students in dormitory rooms often use "lofts" or "loft beds" constructed of lumber, in order to take better advantage of the vertical space in the room. Typically, the sleeping platform is put high enough that a desk and desk chair and/or another piece of furniture can be put under it and used. Tradeoffs are necessary, however. If the sleeping platform is fixed too high, the head, elbows, or knuckles of the user are likely to come into inadvertent contact with the ceiling during normal sleeping movements and/or getting into or out of the bed, thereby causing discomfort or even injury. Also, climbing onto a high sleeping platform of a loft bed can be difficult, and descending from it can be dangerous, particularly in the dark, during emergencies, when the user is not sufficiently awake to exercise appropriate caution, or when the user cannot see the means used to step up to the platform. On the other hand, if the sleeping platform is fixed at a lower position, then during the day access to the desk or other furniture beneath it, which would require crouching even if the platform were fixed at a high position as previously mentioned, is further impeded.

Murphy beds, sofa beds, press beds and the like require considerable time and effort to be moved back and forth between the sleeping position and the stored position, which movement to the stored position entails the further disadvantage of having to remove the bedding (sheets, pillows, blankets, etc.) or at least arrange it precisely or secure it. Also, when such beds are in the stored position they take up space which otherwise would be usable. Other prior art beds need to be recessed in, attached to, or supported by the ceiling or walls of a room and thereby dictate the configuration and dimensions of the room, as well as the locations of the room's windows and doors; these beds are often rather large and as a practical matter are permanent fixtures in the room in which they are installed.

SUMMARY OF THE INVENTION

This invention provides a self-supporting, free-standing bed with a rigid, stationary frame and a platform movable vertically within the frame. The bed does not need to rely upon a ceiling or wall for rigidity or structural support. The platform, which supports the mattress, is easily movable from a lower, sleeping position to a higher, stored position and vice versa within the frame. When the platform is in the higher position, its lowermost part is higher than a person's head height, so that people may walk under it, sit in chairs under it, work at a desk under it, and so on, without crouching, ducking, or bending over. Thus, even though the frame is high, and extends nearly to the ceiling, the bed occupies very little floor space; when the movable platform is in the stored position, only the head and foot of the frame occupy floor space. During the day the platform can be raised to the higher, stored position. At night the platform can be lowered to the lower, sleeping position, where its height is slightly greater (for example, about 16 to 24 inches greater) than the height of an ordinary bed.

Vertically movable counterweights enable the platform to be moved between the stored position and the sleeping position. A person can easily raise or lower the platform manually by pushing up on it or pulling down on it. The platform is connected to the counterweights by ropes or cables running through pulleys or similar means at the top of the frame. Stationary, structural support means define the sleeping position by limiting the downward travel of the platform and supporting the platform in the sleeping position. Such positive support avoids the need for the ropes or cables to ever support the weight of the person using the bed and prevents swinging or other movement of the platform while the person is sleeping on it. Such positive support also allows the platform, when it is in the sleeping position, to clear a desk or chair or similar furniture used under the bed.

To prevent "floating" of the platform in the sleeping position when the user is getting into or out of the bed, the platform, which is then resting on the frame, may be secured to the frame by stationary keepers at the rear of the frame and latching means operable from the front of the bed, whereby the user can move the rear of the platform under and lock it under the keeper by rearward movement of the entire platform, and then restrain the front of the platform from upward movement by operating the latching means, and thus does not have to reach or crouch under the platform or walk around the bed. The movable platform may be elevated to the stored position without making up the bed or securing the bedding; the bedding can simply remain on the bed. The structure and principles of operation of the bed permit it to be simple, sturdy, reliable, relatively easy to assemble and disassemble, adaptable to use in a variety of room layouts, and economical. The pulleys and the ropes or cables are arranged so that the counterweights have a 2:1 mechanical advantage with respect to the platform and so that, during raising or lowering of the platform, forces keeping the ends of the platform horizontal are automatically exerted thereon. This arrangement also provides redundant support for the platform when it is not in the sleeping position.

DRAWINGS ILLUSTRATING THE INVENTION

The presently preferred embodiments of the invention are shown in the following drawings. The drawings are approximately to scale unless otherwise indicated. Figures of the drawings which are not described as isometric are orthogonal.

FIG. 1 is an end view of the bed with a movable platform in the sleeping position.

FIG. 2 s a side view of the bed shown in FIG.

FIG. 6 is a top view of a counterweight.

FIG. 7 is a bottom view of the counterweight shown in FIG. 6.

FIG. 8 is an end, sectional view, taken at 8—8 in FIG. 9, of the counterweight shown in FIG. 6.

FIG. 9 is a side, sectional view, taken at 9—9 in FIG. 8, of the counterweight shown in FIG. 6.

FIG. 10 is a side view of a counterweight cap.

FIG. 11 is a top view of the counterweight cap shown in FIG. 10.

FIG. 12 is an end view of the counterweight cap shown in FIG. 10.

FIG. 12A is an exploded view of the counterweight shown in FIGS. 6, 8, and 9.

FIG. 13 is a top, sectional view of the bed taken at 13—13 in FIG. 2.

FIG. 14 is an end view of the bed with the movable platform in the stored position.

Figure 22:
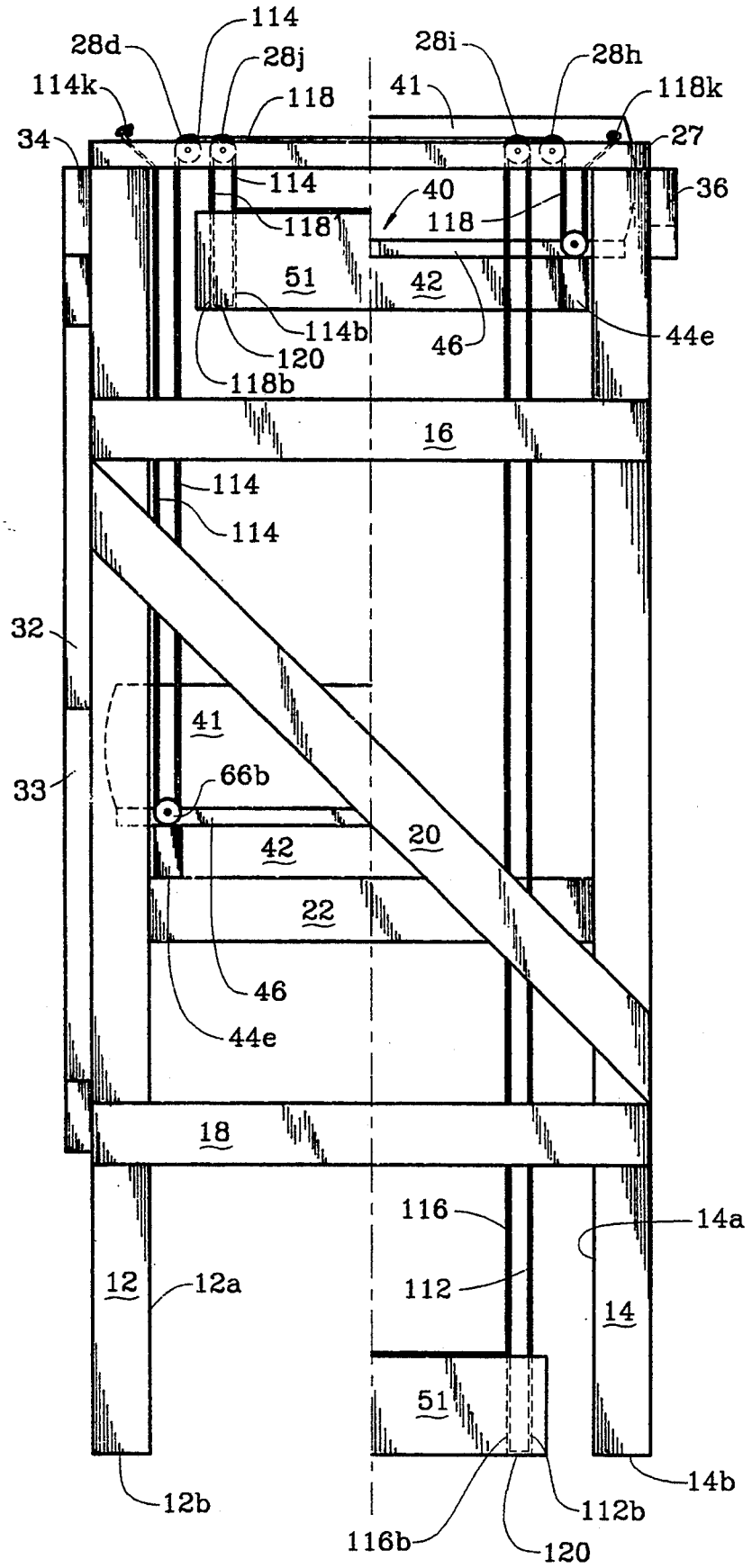

FIG. 22 is an end view of a variation of the bed with ropes passing through a frame member, means for exerting leveling forces on the platform when it is being raised or lowered, and means for providing the counterweights with a 2:1 mechanical advantage with respect to the platform. The left side of FIG. 22 shows the movable platform in the sleeping position, while the right side of FIG. 22 shows the sleeping platform in the stored position.

Figure 23:
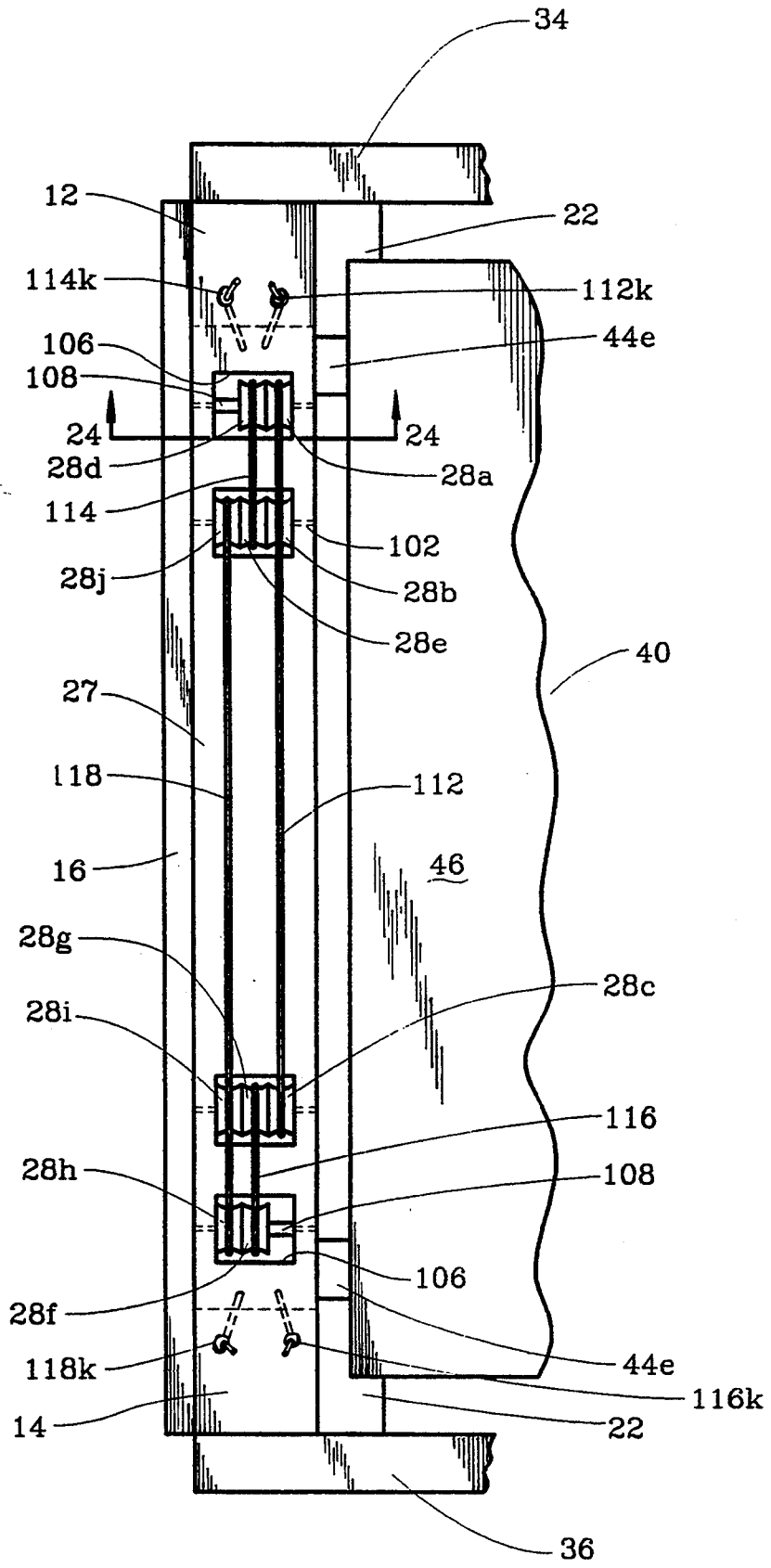

FIG. 23 is a top view of the embodiment shown in FIG. 22, with the mattress removed.

Figure 2:
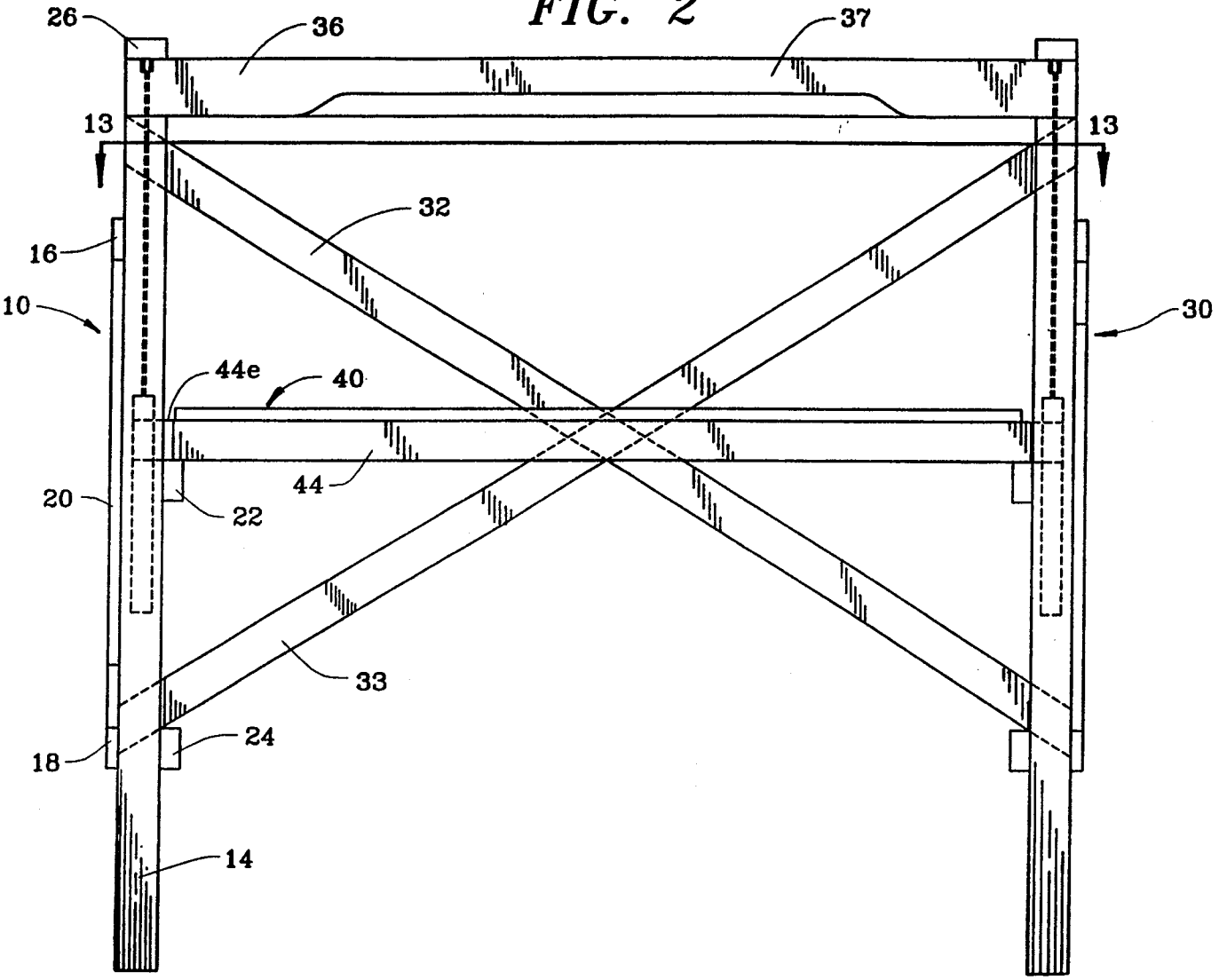

FIG. 2 s a fragmentary, sectional side view of the foot of the bed taken at 24—24 in FIG. 23.

Figure 24:
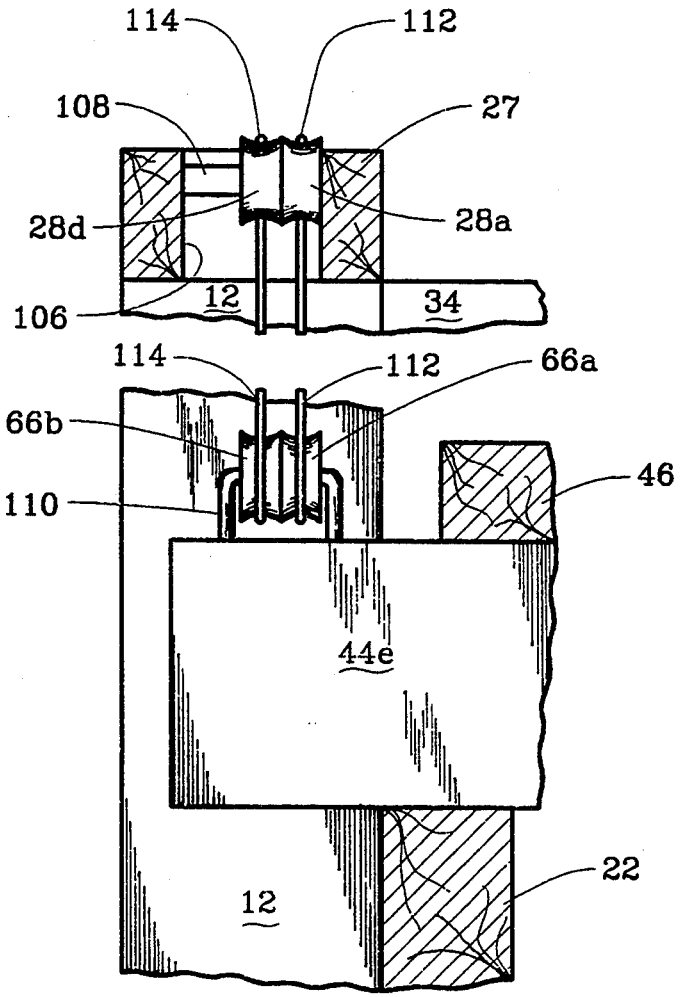
Figure 25:
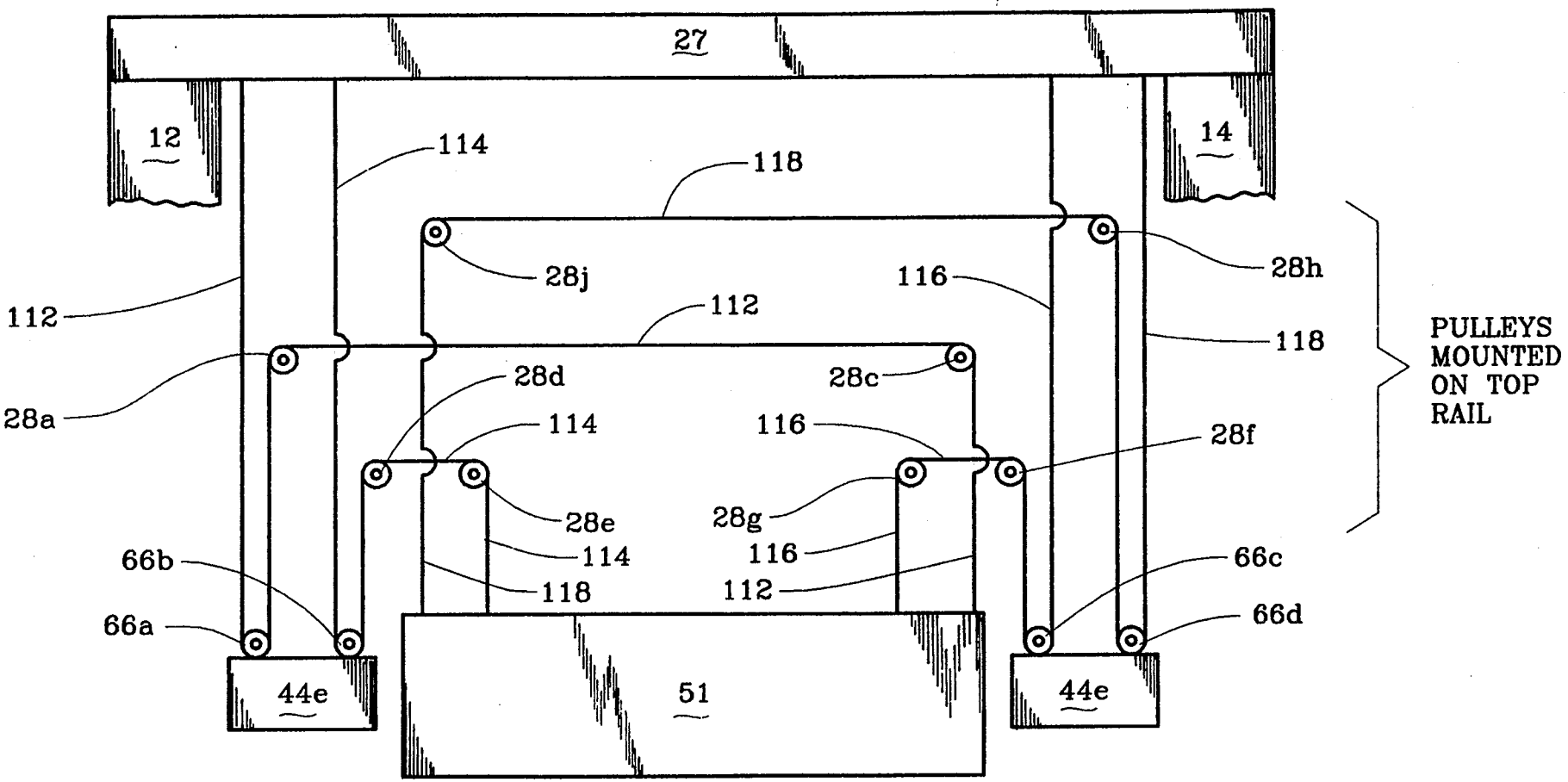

FIG. 25 is a schematic representation of the embodiment shown in FIGS. 22-24, smeared into two dimensions to show each pulley and line.

Figure 26:
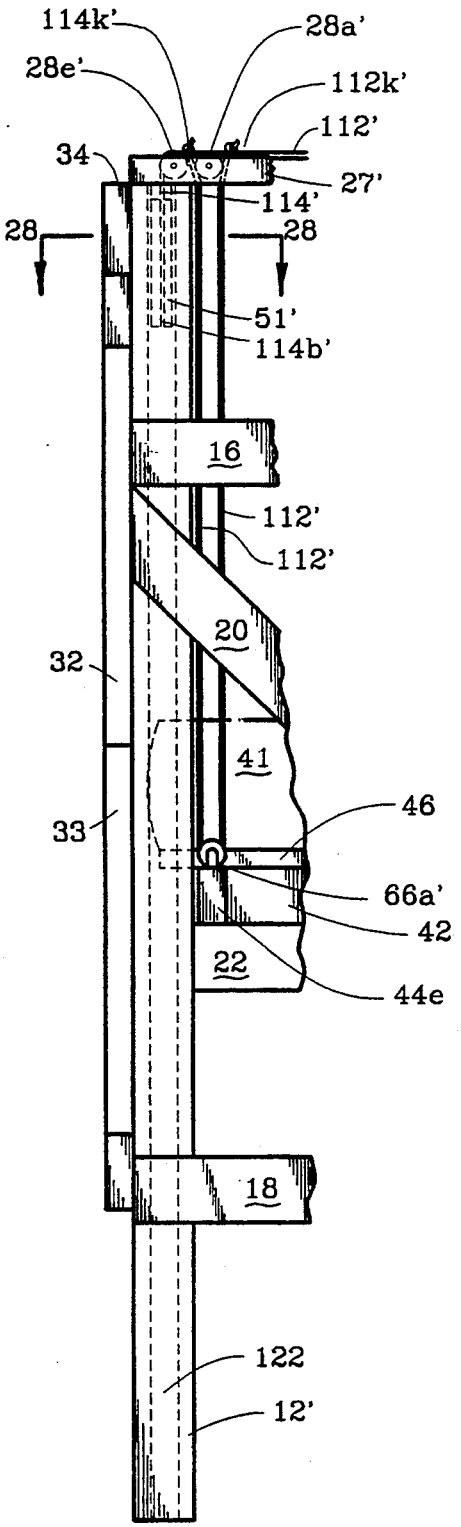

FIG. 26 is a fragmentary, end view of a variation of the bed similar to the embodiment shown in FIG. 22, but with ropes connected to counterweights inside the posts. The movable platform is in the sleeping position.

Figure 27:
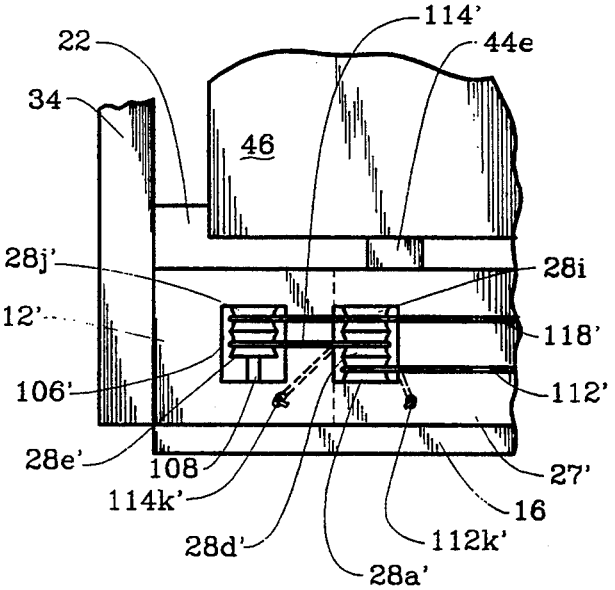

FIG. 27 is a top view of the embodiment shown in FIG. 26, with the mattress removed.

Figure 28:
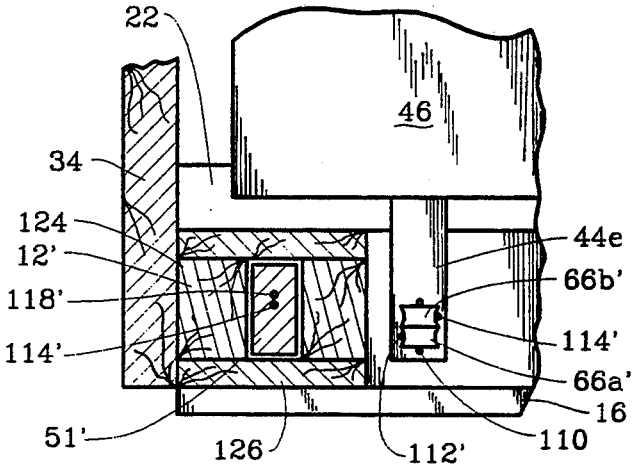

FIG. 28 is a fragmentary, sectional top view of the bed taken at 28—28 in FIG. 26, with the mattress removed.

Figure 29:
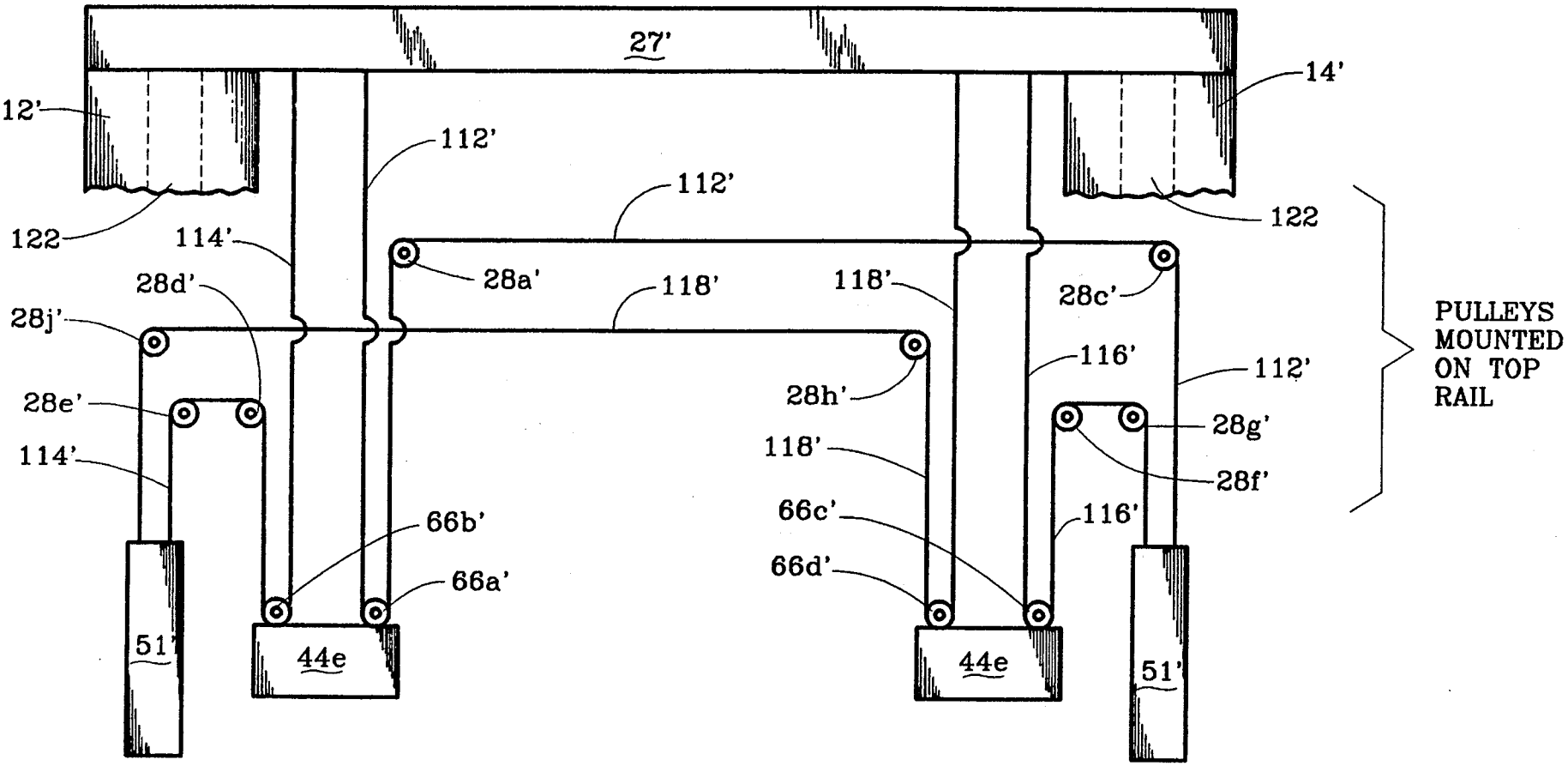

FIG. 29 is a schematic representation of the embodiment shown in FIGS. 26-28, smeared into two dimensions to show each pulley and line.

Figure 30:
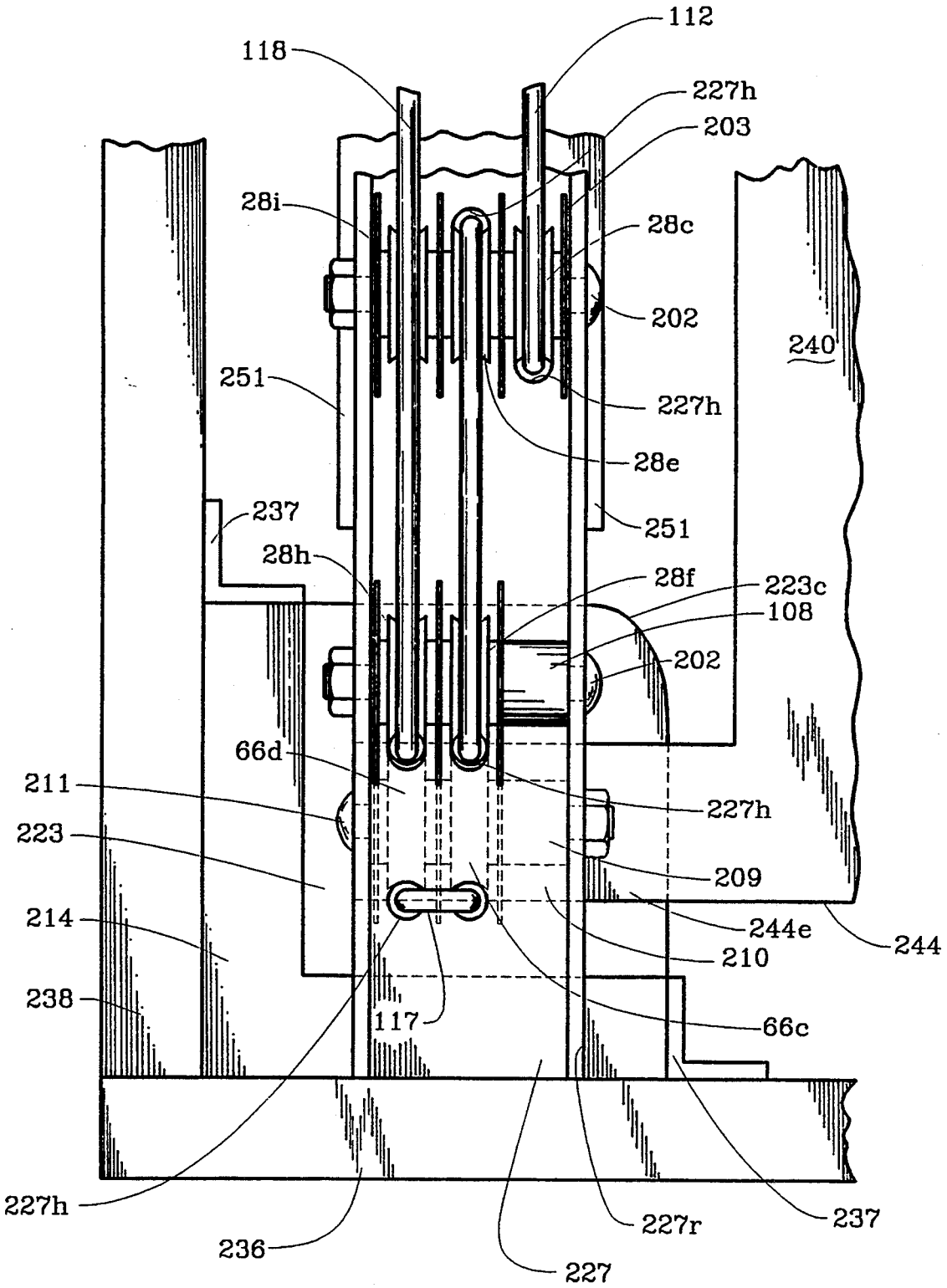

FIG. 30 is a fragmentary, top view of a variation of the bed similar to the embodiment shown in FIGS. 22-24, but with the posts being angles.

Figure 31:
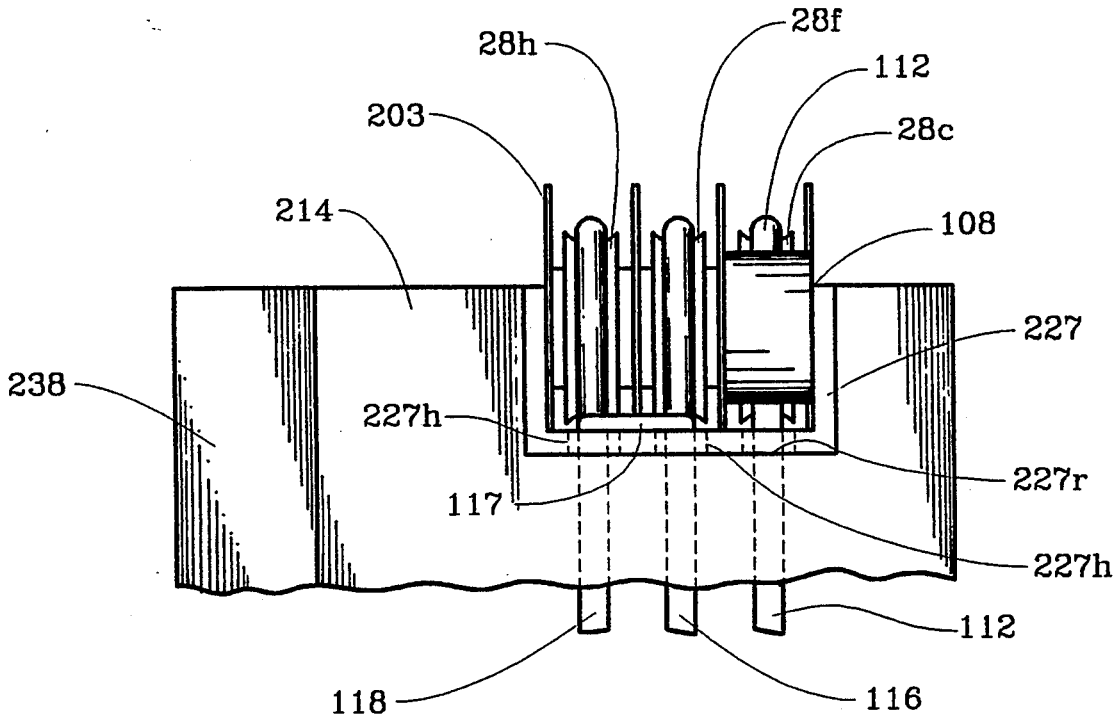

FIG. 31 is a fragmentary, side view of the embodiment shown in FIG. 30, with the front rail removed.

Figure 32:
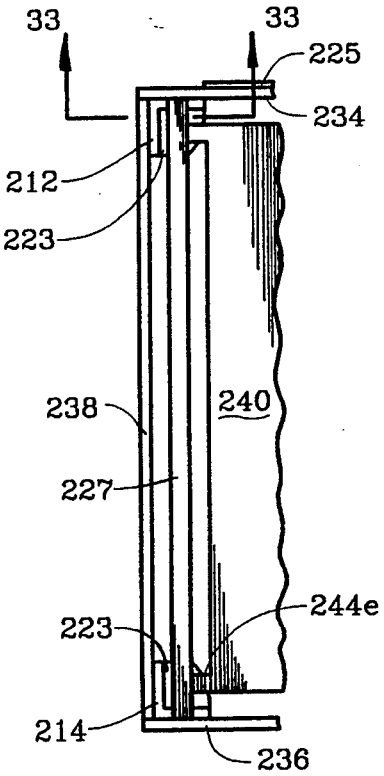

FIG. 32 is a fragmentary, top view of the bed of the embodiment shown in FIG. 30, with the mattress removed.

Figure 33:
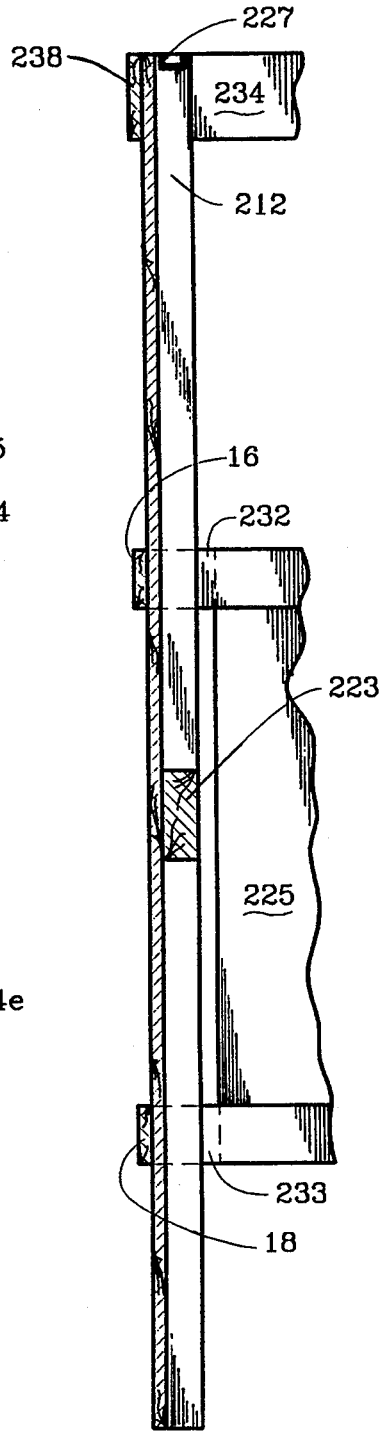

FIG. 33 is a fragmentary, sectional, side view taken at 33—33 in FIG. 32.

Figure 34:
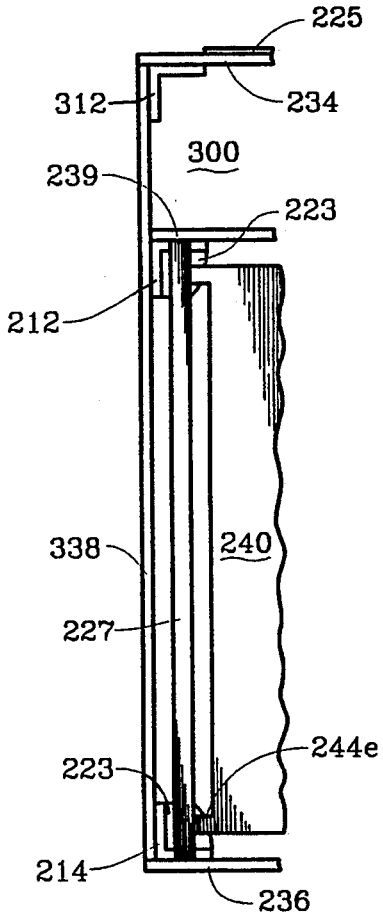

FIG. 34 is a fragmentary, top view of the bed of a variation of the embodiment shown in FIGS. 30-33, with the mattress removed.

DETAILED DESCRIPTION OF PRESENTLY PREFERRED EMBODIMENTS

Figure 1:
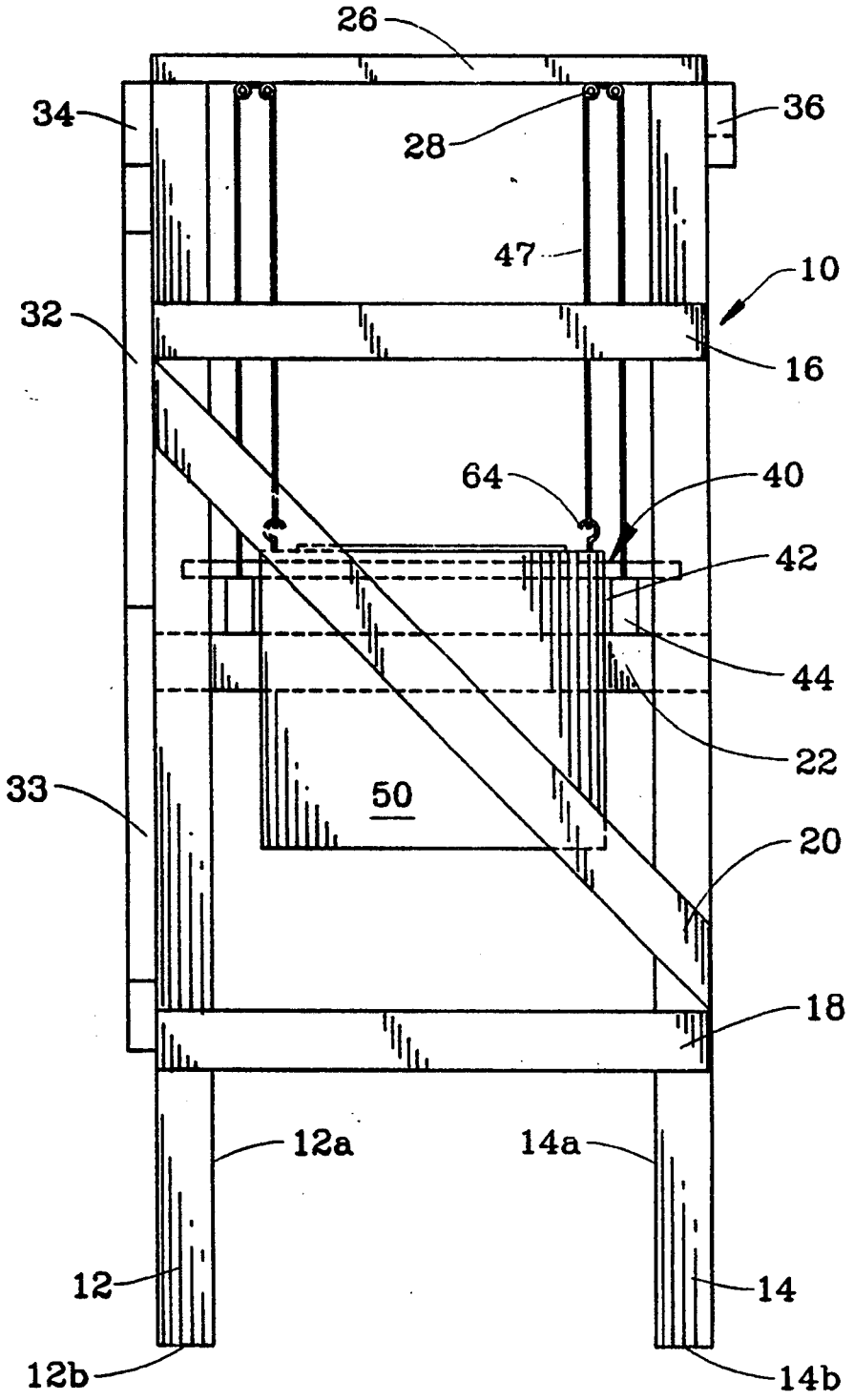

Referring now more particularly to the drawings, FIGS. 1 and 2 show foot 10 of a bed frame. Foot 10 is a rigid structure comprising vertical rear and front posts 12 and 14, exterior cross-braces 16 and 18, exterior diagonal brace 20, interior cross-braces 22 and 24, and top rail 26. These members may be made of wood and fastened together by fasteners such as carriage bolts or hex bolts (not shown) extending through holes at the centerlines of the members, or, in the case of top rail 26, hex screws (not shown). Pulleys 28 are secured to the underside of top rail 26. Rear post 12 has an interior vertical surface 12*a* and a bottom bearing surface 12*b* for supporting the foot structure on a horizontal floor; similarly, front post 14 has an interior vertical surface 14*a* and a bottom bearing surface 14*b* for supporting the foot structure on a horizontal floor.

Head 30 of the bed is identical to foot 10 and is joined thereto by rear X-braces 32 and 33, rear rail 34, and front rail 36, to form the rigid, stationary bed frame. The rear X-braces are mortised where they cross. (As an alternative to the X-braces, the rear braces may take the general shape of an "A", with the top of each brace being fastened to rear rail 34, either close together or spaced apart, and the bottom of each brace being fastened to a rear post.) The rear rail and front rail are somewhat wider than the other members. They are fastened to the posts in the same fashion as the members of foot 10 and head 30, except that rear rail 34 and front rail 36 have two bolt holes spaced vertically from their centerlines to eliminate their tendency to rotate at the joints with the posts. Front rail 36 is reduced in height at its central part 37, so that its underside is farther from the floor there.

Figure 5:
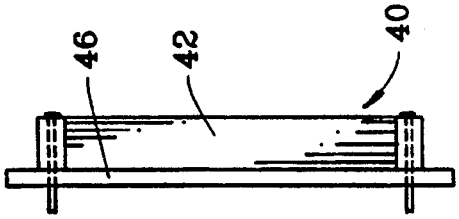
FIG. 5 is an end view of the movable platform shown in FIG. 3.
Figure 3:
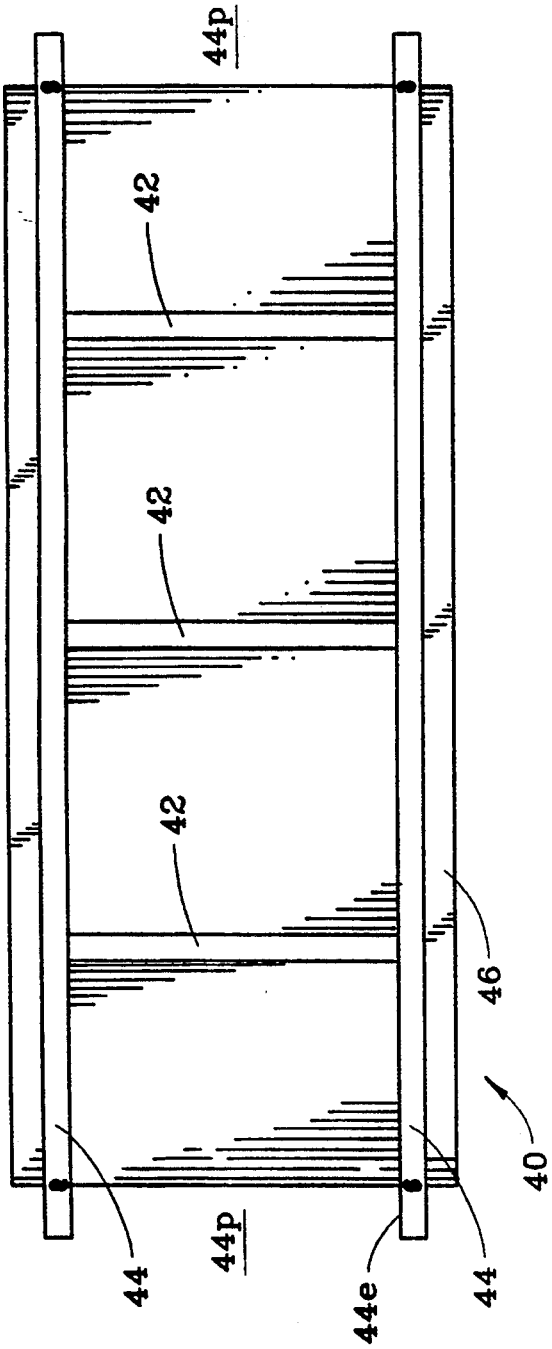
FIG. 3 is a bottom view of the movable platform.
Figure 4:
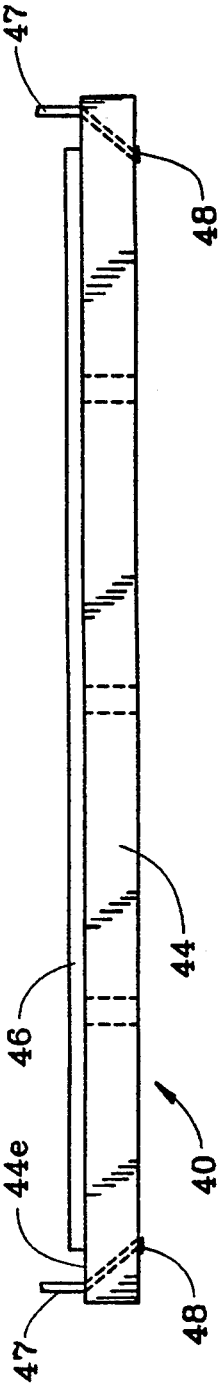
FIG. 4 is a side view of the movable platform shown in FIG. 3.

Movable platform 40 shown in FIG. 1 is also shown in FIGS. 3 through 5. It is comprised of cross-rails 42 joined to side rails 44, with the frame they form being joined to deck 46 by fastening means such as nails, screws, and glue. Side rails 44 extend beyond deck 46 at 44*e*, so as to define passages 44*p*. Platform 40 can be supported by ropes or cables 47, which pass through holes of side rail ends 44*e* and are secured by means such as knots 48.

Counterweight 50 shown in FIG. 1 is also shown in FIGS. 6 through 12A. It is comprised of a hollow, rectangular box 52, ballast 58, and cap 60. The hollow box is made of panels 53, vertical members 54, and bottom member 56, which are joined together by fastening means such as nails and glue. Ballast 58 consists of lengths of steel reinforcing rod which are placed inside the hollow box and are supported by panels 53. Alternatively, lengths of iron or steel bar of rectangular cross-section may be used as ballast. Cap 60 consists of lid 61 and plug 62, which is sized to fit closely into the open end of hollow box 52. After the desired weight of ballast has been placed in hollow box 52, the open end of the box is closed by cap 60. Screw hooks 64 are screwed into the ends of vertical members 54 so that counterweight 50 can be supported by ropes or cables.

As shown in FIGS. 1, 2, and 13, when the movable platform 40 is in the sleeping position, side rail ends 44*e* rest on interior cross-brace 22 of foot 10. Lines 47 extend upwardly around pulleys 28 and then back down to, and are secured to, hooks 64 of counterweight 50, whereby counterweight 50 is suspended by the lines. (The term "line" will be used herein to mean a rope, cable, chain, or the like.) Movable platform 40 and another counterweight are supported by head 30 in the same manner.

The weight of the ballast in counterweight 50 is selected so the sum of the weights of the two counterweights are approximately equal to the sum of the weights of movable platform 40, the mattress, sheets, blankets, a pillow, etc. (not shown) carried by the movable platform.

Figure 15:
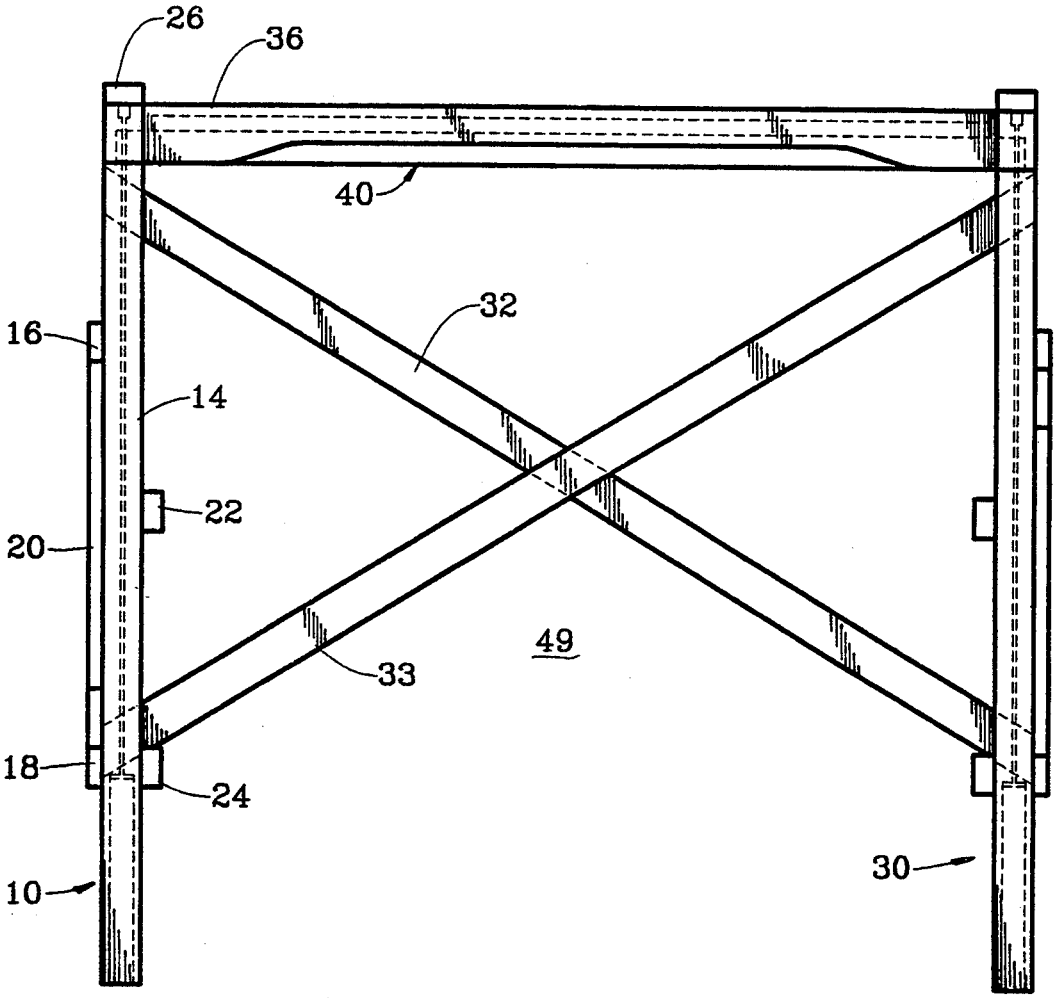
FIG. 15 is a side view of the bed shown in FIG. 14.

Accordingly, when the bed is not being used for sleeping, one can easily raise platform 40 manually to the position shown in FIGS. 14 and 15, so that the lowermost portion of platform 40 is substantially higher than one's head height. The lowermost portion of platform 40 should be a distance of at least 60 inches above the floor. As best shown in FIG. 15, front rail 36 also should be spaced at least 60 inches above the floor (i.e., the plane of the posts' bottom bearing surfaces), so that front rail 36 defines, with front posts 14, a large, unobstructed, rectangular opening 49. These distances should be sufficient to enable a person 58 inches tall to walk safely through this opening and stand under platform 40 without crouching, ducking, or bending over, and with at least two inches to spare. Of course, the actual distances can depend upon the height of the person using the space under the movable platform, and in most cases will be greater than 60 inches. Since the top of the bed frame is open, as best shown in FIG. 13, the mattress and bedding can be elevated through the opening until they are well above top rails 26 or at least a portion thereof. As platform 40 is being raised, counterweights 50 are being lowered, until both reach the positions shown in FIGS. 14 and 15. As best shown in FIG. 13, platform side rail ends 44*e* are spaced from posts 12, 14, as are the head and foot ends of platform deck 46. The resulting clearances between the platform and the posts permit the components of the bed to be assembled without the need for adherence to close tolerances and reduce the possibility of binding between the platform and the posts during raising or lowering of the platform. These clearances are especially important when one or more of these components are made of wood, which tends to swell when moisture is present. Each counterweight 50 moves within a passage 44*p* between platform side rail ends 44*e* as well as within a passage defined by the interior vertical surface 12*a* of rear post 12 and the interior vertical surface 14*a* of front post 14.

Figure 16:
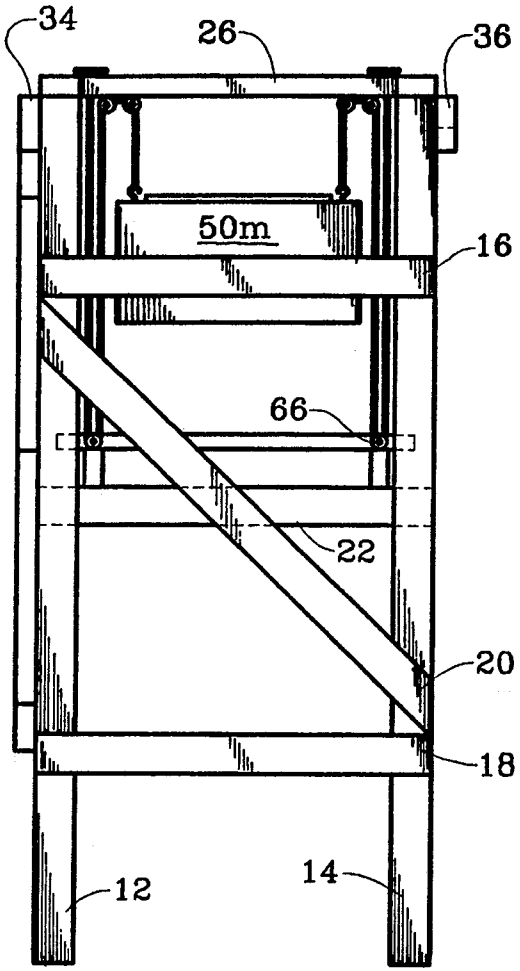
FIG. 16 is an end view of a variation of the bed in which lighter counterweights enjoy a 2:1 mechanical advantage with respect to the movable platform.

In the variation of the invention shown in FIG. 16, counterweight 50*m* can be smaller and lighter than counterweight 50 because the different pulley arrangement (with the lines passing through pulleys 66 secured to side rail ends 44*e*) provide the counterweights with a 2:1 mechanical advantage with respect to platform 40. That is, the sum of the weights of the two counterweights is approximately equal to half the sum of the weights of movable platform 40, the mattress, and bedding. Of course, this means that the each counterweight 50*m* must travel twice as far as platform 40 when the bed is changed from the sleeping position to the stored position.

The height of cross-brace 22, which defines the lower limit of the travel of platform 40, may be varied to suit the needs of the user. If, for example, the user wishes to put a desk inside the bed frame, the height of the top of cross-brace 22 should be in the range of 40 to 48 inches from the floor, so that in the sleeping position platform 40 will clear the desk and books and other items left on the top of the desk. If there are bookshelves on the desk, then cross-brace 22 should be positioned higher, say 54 inches from the floor. Holes should be predrilled in posts 12 and 14 about every 4 inches to suit varying needs. The reduced height of front rail 36 at its central part 37 increases clearance to facilitate getting into and out of the bed when cross-brace 22 is positioned relatively high; moreover, this reduced height makes front rail 36 easier to grasp when the user is getting in and out.

As best shown in FIG. 14, the upper limit of travel of platform 40 may be defined by the length of line 47—the longer the line, the sooner the counterweight will contact the floor, and the lower will be platform 40 in the stored position. If line 47 is so short that this upper limit is not so defined, the upper limit will be defined by the bedding contacting the ceiling, or by hooks 64 or pulleys 66 contacting pulleys 28. The distance between the floor and the lowermost part of platform 40 should be at least 2 inches greater than the heights of the user and others who may be standing or sitting under the platform, since it is difficult for one to see obstructions above eye level. The minimum clearance should be 60 inches.

Typically the user of the bed will desire platform 40, when it is in the stored position, to be as high as possible without touching the ceiling. The ability of the mattress and bedding to be elevated above at least the bottom surfaces of top rails 26, combined with the ability to define the upper limit of travel of platform 40 by selecting the length of line 47, provide greater design flexibility, since it is not necessary to make the height of the posts as close as possible to the height of the ceiling of the particular room. Thus, the posts may be made short enough to fit in most rooms, yet still allow the platform to be at the maximum desired height when it is in the stored position in a particular room. Also, shorter posts are easier to handle when they are being transported.

When cross-brace 22 is relatively high with respect to the height of the user, platform 40 may tend to "float" when it is in the sleeping position and the user is getting into it, due to the balancing of weights described earlier and any upward forces the user exerts on platform 40 while climbing onto it. This tendency may be eliminated by securing platform 40 to the bed frame when it is in the sleeping position. Since it would be awkward for the user to operate securing devices at the rear of the platform when it is in the sleeping position, the features shown in FIGS. 18 through 21, which are hereinafter described, enable the user to secure the platform without having to get under or behind it.

As shown in FIGS. 17, 18, 18A, 18B, 18C, and 19, stationary keeper 70 projecting from the front surface of post 12 defines recess 72, whose height is slightly greater than the height of side rail end 44*e*. Keeper 70 has a triangular cross-section, so that when platform 40 is being lowered toward cross-brace 22, side rail end 44*e* is cammed forward and rides over the inclined front surface 71 of keeper 70. When side rail end 44*e* reaches cross-brace 22, however, the user pushes platform 40 rearward, so that end 44e moves under, and is locked under, the bottom surface of keeper 70. Since foot 10 and head 30 are identical, both ends 44e of the rear side rail 44 may be locked under identical keepers in this manner. The user may effect such locking while standing in front of platform 40, and does not have to reach to the rear of platform 40 to operate any latching device. As an alternative to a keeper projecting from the front surface of the post, the front surface of the post may be provided with a rectangular recess to receive the side rail end, so that the top of the recess constitutes the keeper when the side rail end is pushed rearward.

Figure 17:
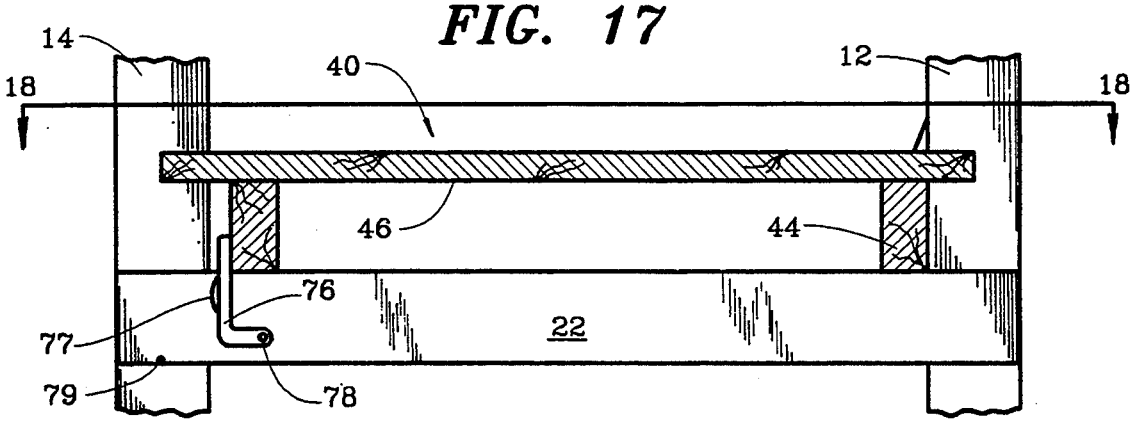
FIG. 17 is a fragmentary, sectional, end view of the foot of the bed as viewed from the interior of the bed frame, of a variation of the bed in which the movable platform is locked to the frame.
Figure 18:
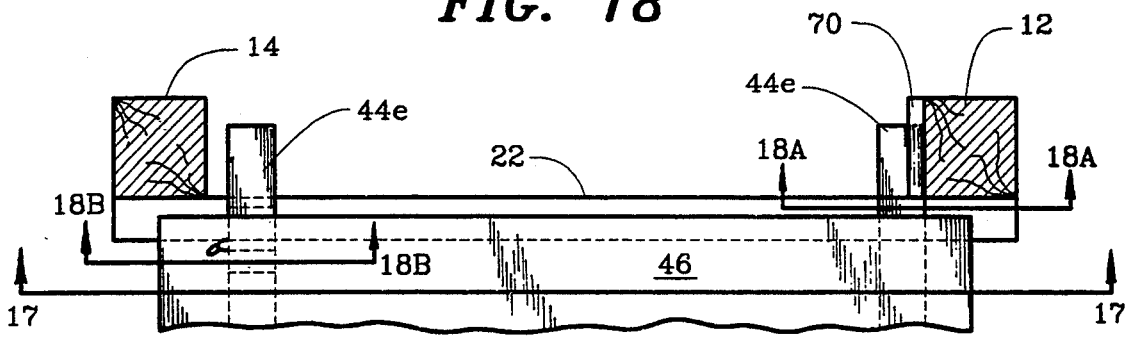
FIG. 18 is a fragmentary, sectional, top view of the variation shown in FIG. 17 as viewed from the exterior of the bed frame.
Figure 18C:
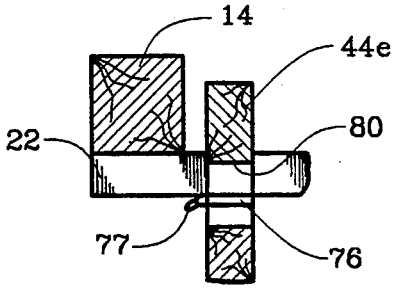
FIG. 18C is a fragmentary, sectional top view of the foot of the bed taken at 18C—18C in FIG. 18B.
Figure 18B:
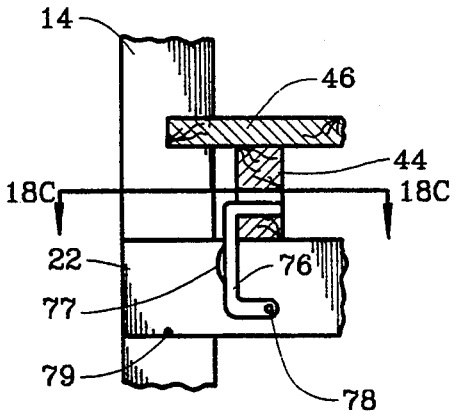
FIG. 18B is a fragmentary, sectional end view of the foot of the bed as viewed from the interior of the bed frame, taken at 18B—18B in FIG. 18.
Figure 18A:
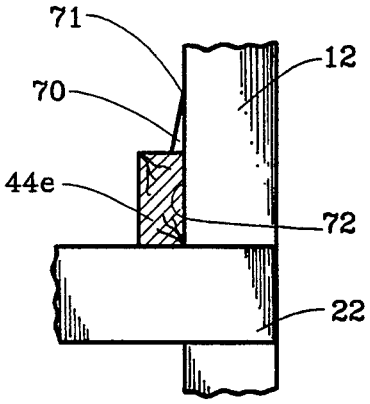
FIG. 18A is a fragmentary, sectional end view of the foot of the bed as viewed from the interior of the bed frame, taken at 18A—18A in FIG. 18.
Figure 19:
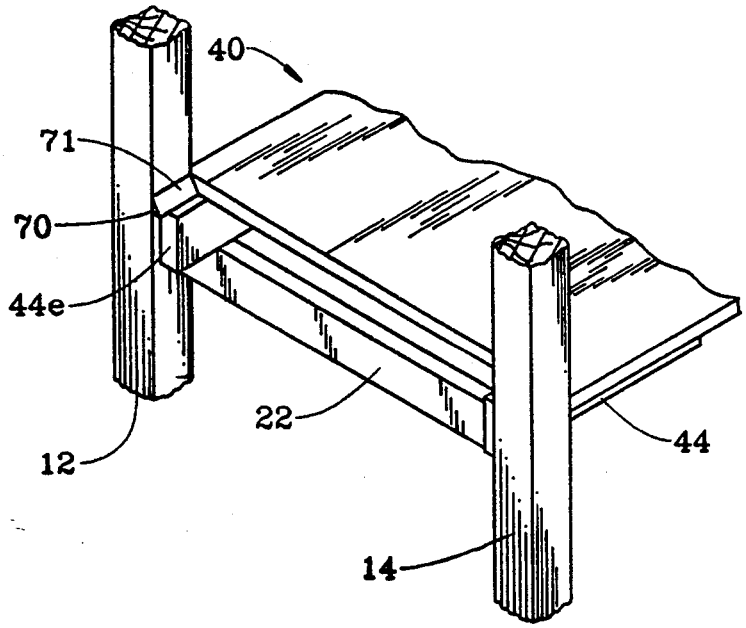
FIG. 19 is a fragmentary, isometric view of the variation shown in FIG. 17.
Figure 20:
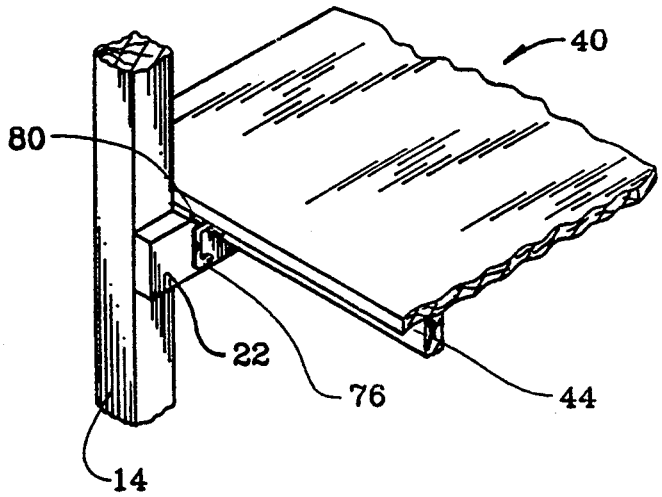
FIG. 20 is another fragmentary, isometric view of the variation shown in FIG. 19, rotated 90 degrees clockwise about the longitudinal axis of the near post.
Figure 21:
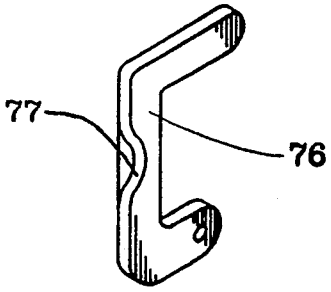
FIG. 21 is an isometric view of the hook shown in FIG. 17.

To keep platform 40 from moving forward and/or upward and thereby coming out from under keeper 70, front latching means have been provided in the form of hook 76, which is rotatably fastened to cross-brace 22 by bolt or screw 78. To latch platform 40, hook 76 is rotated clockwise (as shown in FIGS. 17 and 20), so that its end engages the bottom of recess 80 in side rail end 44e. Recess 80 is a hole through side rail end 44e, which is elongated horizontally (as best shown in FIG. 18C), so that the user will not have to position platform 40 to the left or right in order to engage hook 76. As best shown in FIG. 21, hook 76 has a raised tab 77 to facilitate grasping when the hook is lying alongside cross-brace 22. Preferably the hole in which fastener 78 is disposed contains a nylon insert, so that the fastener can be tightened to hold the hook so that it does not swing freely, but instead holds the position in which it is placed. As best shown in FIGS. 16 and 18B, screw 79 serves as a stop for hook 76 when it is rotated counterclockwise, thereby preventing hook 76 from hanging down below cross-brace 22 and possibly catching onto the user or the user's clothing. Since foot 10 and head 30 are identical, both ends 44e of front side rail 44 are latchable in the same manner.

The bed may be constructed of standard lumber and other standard materials. For example, in the bed frame the posts can be made of 4×4s, the exterior cross-braces and diagonals of 1×4s, the rear and front rails of 2×6s, and the interior cross-braces, the X-braces, and the top rails of 2×4s. (All lumber dimensions are nominal unless otherwise indicated.) In the movable platform the cross-rails and side rails may be made of 2×4s and the deck of a 36 inches wide interior hollow door attached and its sides and ends, by horizontal screws and glue, to 2×4s ripped to the thickness of the door; vertical screws through these 2×4s so attached may attach the deck to the cross-rails and side rails. In the counterweights, the vertical and bottom members and the plug of the cap may be made of 2×4s and the panels and lid of the cap of ¼ inch plywood; the panels should be nailed securely to the vertical and bottom members. Nylon rope of ¼ inch thickness, polyester rope of 3/16 inch thickness, or steel cable of 1/16, 3/32, or ⅛ inch thickness may be used. The hex bolts may be of 5/16 inch thickness. Desirably they should be countersunk at both the head and nut ends, which will necessitate the use of two socket wrenches for assembly.

Typical dimensions are as follows: post length—90 inches; length of exterior cross-braces, interior cross-braces, and top rails—40 inches; length of rear and front rails—92 inches; length of platform cross-rails—29 inches; length of platform side rails—90 inches; deck—83×37.5×1.375 inches; counterweight—21×24.5×2.25 inches, when the counterweight does not enjoy a mechanical advantage with respect to the platform.

Of course, the bed may be made of other materials. It is important to make the movable platform as light as possible. The deck could be made of a honeycomb or plastic foam core panel. Alternatively, it could be made of a metal frame with metal springs of the kind used in bunk beds. Recycled plastic members may be substituted for the lumber, and in the movable platform could be hollow. The counterweight may be unitary, with provisions to add small amounts of weight to balance the actual weight of the mattress and bedding. To eliminate any possibility of contact with the counterweights, or to provide privacy or a darker environment for sleeping, panels may be affixed to the interior and/or exterior surfaces of the posts to enclose the areas not occupied by the cross-braces and diagonals. Alternatively, a roller-mounted, spring-tensioned window shade may be affixed to one or more top rails 26 or interior cross-braces 22 so that the shade may be pulled down along the interior surfaces of the posts.

For ease of assembly, the movable platform is reversible, foot 10 and head 30 are interchangeable, and the counterweights are reversible and interchangeable.

Thus, the bed according to the present invention is self-supporting and free-standing. It does not need to be recessed in, attached to, or supported by the ceiling or walls of a room, although it may be, if desired. It does not dictate the configuration of the room in which it is to be located. It is relatively compact, being only slightly longer than the mattress used on it. It is a discrete item of furniture which may be used in almost any room, may be located at alternative locations within a room, and may be easily disassembled and moved from place to place. Also, it may be constructed of relatively inexpensive materials and does not require adherence to close tolerances in its manufacture and assembly.

As shown by the drawings, particularly FIG. 13, and by the foregoing typical dimensions, the clearances between platform side rail ends 44e and platform deck 46, on the one hand, and posts 12, 14, on the other, are selected so that when sleeping platform 40 is in the sleeping position side rail ends 44e always rest on an interior cross-brace 22 without extending beyond the cross-brace, regardless of how platform 40 is moved. Thus, platform 40 may be moved all the way to the left, right, rear, or front, or rotated in a horizontal plane, without slipping off the interior cross-braces or interfering with an exterior brace. For example, each platform side rail end 44e projects 3.5 inches beyond deck 46, which is less than the 4 inch width of surfaces 12a and 14a of posts 12 and 14, so that if platform 40 is moved all the way to the left as shown in FIG. 13, side rail ends 44e can never contact an exterior brace 16, 18, or 20. Also, if platform 40 is moved all the way to the right, the right edge of 20 deck 46 will strike the front head post before the left side rail end 44e can slip off interior cross-brace 22. Similarly, when platform 40 is moved all the way to the rear, the rear side rail ends 44e will contact the rear posts before the rear of deck 46 can contact X-rail 32 or 33 or rear rail 34 and before the front side rail ends 44e enter the path of counterweight 50, and when platform 40 is moved all the way to the front, the front side rail ends 44e will contact the front posts before the rear of deck 46 can contact front rail 36 and before the rear side rail ends 44e enter the path of counterweights 50.

In addition, the platform, when connected to the ropes or cables, may be rotated about its longitudinal axis or its transverse axis, without slipping off an interior cross-brace.

As best shown in FIG. 2, when the lines are not so connected the movable platform may be removed by elevating its left end, for example, until it is directed to the opening between cross-braces 16 and 22, moving the platform to the left along its longitudinal axis and through that opening, lowering the right end of the platform until it is near the floor and the platform is generally parallel to X-brace 32, and moving the platform to the front, and out through the rectangular opening defined by the front posts and the front rail. To install the platform in the fully assembled frame, these steps are reversed.

In the variations of the invention shown in FIGS. 22–34, the pulleys are recessed in each top rail, means are provided for automatically exerting leveling forces on the movable platform when it is being raised or lowered, and the counterweights have a mechanical advantage of 2:1 with respect to the platform, since they are arranged as previously described with respect to the embodiment shown in FIG. 16.

In the embodiment shown in FIGS. 22–25, which will be described next, pulleys 28 are mounted on four axles 102 extending through top rail 27. Each axle 102 may be a bolt whose head and nut are countersunk in opposite sides of top rail 27 and hence are not shown. Pulleys 28 are disposed in four recesses or cavities 106. There are ten pulleys 28: 28*a*–29*j*. Two pulleys are on each of the two axles 102 nearest the front and back of the bed and are held in position by spacers 108. Three pulleys are on each of the remaining two axles 102.

The location of pulleys 28 accomplishes several things. First, safety is enhanced because in the event of a complete failure of one or more pulleys their attaching means, the counterweight or platform or portion thereof it supports will not fall. The line will merely be suspended by the solid portion of top rail 27 between cavities 106. The line will cease moving freely, however, which will warn the user of the bed that repair is necessary. Second, the elimination of the need for means for attaching the pulleys to a surface permits the use of more freely turning and cheaper pulleys. Ball bearing wheels sold for repairing sliding glass patio doors have been found satisfactory. Third, removing the pulleys from the bottom surface of the top rail allows the heights of posts 12 and 14 to be decreased by the diameter of the pulleys (plus the additional height of the means for attaching them to the bottom surface of the top rail), without decreasing the maximum height of the movable platform in the stored position. Fourth, recessing the pulleys in the top rail reduces the overall effective height required by the top rail and pulley assembly. Fifth, the location of the pulleys reduces the likelihood of bedding or the like being caught in them.

As shown in FIG. 24, pulleys 66 are secured to side rail ends 44*e* by U-bolt 110 extending through holes therein and held by nuts which are countersunk in the bottom thereof and hence are not shown. As best shown in FIGS. 23 and 25, there are four pulleys 66: 66*a*–66*d*.

Functionally, there are four lines: 112, 114, 116 and 118. These are best shown in FIGS. 23 and 25. Line 112 is secured to top rail 27 at knot 112*k* and extends downward to pulley 66*a* on rear side rail end 44*e*, under and around pulley 66*a*, upward to pulley 28*a*, over and around pulley 28*a*, forward over idler pulley 28*b* and over and around pulley 28*c*, and downward to the front of counterweight 51, where it is secured. Line 114 is secured to top rail 27 at knot 114*k* and extends downward to pulley 66*b* on rear side rail end 44*e*, under and around pulley 66*b*, upward to pulley 28*d*, over and around pulley 28*d*, forward over and around pulley 28*e*, and downward to the rear of counterweight 51, where it is secured. Line 116 is secured to top rail 27 at knot 116*k* and extends downward to pulley 66*c* on front side rail end 44*e* (as shown schematically in FIG. 25), under and around pulley 66*c*, upward to pulley 28*f*, over and around pulley 28*f*, rearward over and around pulley 28*g*, and downward to the front of counterweight 51, where it is secured. Line 118 is secured at knot 118*k* to top rail 27 and extends downward to pulley 66*d* on front side rail end 44*e* (as shown schematically in FIG. 25, under and around pulley 66*d*, upward to pulley 28*h*, over and around pulley 28*h*, rearward over idler pulley 28*i* and over and around pulley 28*j*, and downward to the rear of counterweight 51, where it is secured.

Actually, there are only two lines, rather than four. Line 114, which passes through vertical bore 114*b* in counterweight 51, is continuous with line 118, which passes through vertical bore 118*b* in counterweight 51. Similarly, line 112, which passes through vertical bore 112*b* in counterweight 51, is continuous with line 116, which passes through vertical bore 116*b* in counterweight 51. Passage 120 connects bores 114*b* and 118*b*, and passage 122 connects bores 112*b* and 116*b*; the lines are disposed in these passages so that they do not protrude from the bottom of counterweight 51. The friction of the lines in these bores and passages tends to keep the lines secured to the counterweights, while still allowing some movement of the lines therein to effect minor adjustment of the lines with respect to the counterweights and leveling the counterweights. When the minor adjustments have been completed, the lines may be finally fixed with respect to the counterweights by collars or nylon locking cable ties applied to them immediately above the top of the counterweight.

Lines 112, 114, 116, and 118 are secured to top rail 27 by knots 112*k*, 114*k*, 116*k*, and 118*k* respectively, which are larger than the bores in top rail 27 through which the lines pass. If desired, knots 112*k* and 114*k* can be eliminated and lines 112 and 114 made continuous at the top of the rear of top rail 27, so that functional lines 112, 114, 116, and 118 may actually be only one continuous line. Knots 116*k* and 118*k* can then be eliminated by joining lines 116 and 118 at the top of the front of top rail 27. This would be particularly desirable when the lines are steel cable.

Mattress 41 is supported by platform 40, as previously described.

As mentioned previously, pulleys 28 and 66 may be ball bearing wheels for sliding glass doors. They may be of any convenient diameter, such as 1.0 or 1.5 inches; these diameters are measured at the widest part of the pulley, its side faces. Axles 102 may be 0.25 inch hex bolts. U-bolts 110 may be 0.25 inch diameter threaded steel rod bent into the U-shape after the wheels have been disposed thereon. To keep the lines from coming off the pulleys when the lines are slack, as for example may occur when the movable platform is pushed up after the counterweight has contacted the floor, fender washers (not shown) may be placed on the axles between the pulleys and at the side faces of the pulleys which are not adjacent another pulley; the diameter of such washers should be about 0.5 inch greater than the diameter of the adjacent pulleys. To avoid unnecessary friction, the rotating part of each pulley 28 should not contact the sides of recess 106. When sliding glass door pulleys are used, the hub of the wheel may contact a side of the recess, but since the hub is wider (in the direction of the axle) than the outer, rotating part of the wheel, that rotating part will not contact a side of the recess.

These means for automatically exerting leveling forces on the platform when it is being raised or lowered tend to keep the head edge and the foot edge of the platform horizontal. This facilitates raising and lowering the platform.

When raising or lowering the platform of the embodiment of the invention shown in FIGS. 1 through 16, the user typically gets under the platform, places his or her hands at two places near its longitudinal axis, grasps the platform, and either pulls it down or pushes it up. Often one corner of the platform will move ahead of the rest of the platform. This situation tends to perpetuate itself, probably because the pulleys' coefficient of static friction is greater than their coefficient of kinetic friction and/or because the inertia of the moving platform tends to keep it moving. To correct the situation the user may hold back the portion moving ahead and exert more force on the portion moving behind, which requires one arm to work against the other. The user may also change hand position, in an effort to achieve better balance. The user may also resort to raising or lowering the platform by several separate, sequential efforts using different hand positions. The user may even have to abort the effort, move the platform back to its original position, and begin again.

In contrast, the automatic leveling means of FIG. 22–24 allow the user to raise and lower the platform from the front of the bed, since each rear corner will automatically position itself at the level of the adjacent front corner. That is, the head edge of the platform and the foot edge of the platform always remain horizontal. The user may stand midway between the head and the foot of the bed, place his or her hands on side rail 44 of platform 40 at about shoulder width apart, grasp side rail 44, and push up or pull down. Alternatively, the user may stand at the front of the bed at the foot, for example, grasp side rail 44 with one or both hands, and push up or pull down, whereby the foot of platform 40 will move up or down. Then the user moves to the head of the bed and repeats that procedure, whereby the head of platform 40 will move up or down and platform 40 will be horizontal. This alternative, two-step technique is preferred, because it decreases the force the user is required to exert.

Other variations will be apparent to those skilled in the art. If it is desired to keep the entire platform horizontal while it is being raised or lowered, additional lines may be run through additional pulley arrangements from (1) front, head side rail end 44*e* to the front of foot counterweight 51; (2) front, foot side rail end 44*e* to the front of head counterweight 51; (3) rear, head side rail end 44*e* to the rear of foot counterweight 51; and (4) rear, foot side rail end 44*e* to the rear of head counterweight 51. With this arrangement platform 40 will remain horizontal even though it is pushed up or pulled down at only one point anywhere on the platform.

The automatic leveling means have other important advantages. First, the lines redundantly support the platform. If one line fails (for example, by breaking or becoming unsecured) or its attaching means fails, the corner of the platform will not fall. Second, such a failure will probably become evident to the user during subsequent raising or lowering of the platform because the failure will prevent that line from providing a leveling force tending to keep the head edge and the foot edge of the platform horizontal, so that the user can repair the failure and check for wear or incipient failures of a similar nature. Third, since the head and foot edges of the platform remain level, the counterweights also remain level, which prevents their bottom corners from banging into the posts or becoming hung up on them.

The variation of the invention shown in FIGS. 26–29 is similar to the embodiment shown in FIGS. 22–25, except that the posts are hollow and there are four counterweights, each of which is enclosed within a post. In effect, each of the two counterweights of the embodiment of FIGS. 22–25 has been cut in half along its vertical axis, the resulting four counterweights reshaped to fit passages in the posts and moved to the front and back of the bed, and the system of pulleys and lines modified accordingly.

More specifically, rear post 12', which is identical to the front post, has internal passage 122 with counterweight 51' disposed therein for vertical movement. Posts 112 may be made of standard lumber nailed and/or glued together, such as 2×4s 124 and 1×6s 126. Post 12' is fastened to the other members by bolts (not shown) which do not obstruct passage 122; for example, long bolts fastening post 12' to cross-braces 16 and 22 may run through the long dimension of 2×4 124 and through both 1×6s; short bolts fastening post 124 to X-braces 33, 34 may run through the center of the short dimension of 2×4 124 with a nut in a countersink in the face thereof defining passage 122 and the nut being accessible through a hole in the opposite 2×4 124. By varying the dimensions of the lumber the cross-sectional area of passage 122 can be varied as desired, to provide adequate space for a counterweight 51' having a height which is sufficiently small that it allows platform 40 to have a sufficient range of travel. Removable panels (not shown) may be provided in the surfaces of the posts against which cross-braces 22 abut, at the tops and/or the bottoms of the posts, to provide access to counterweights 51' for changing them or adding or removing weight to or from them.

In FIGS. 26–29, features or elements which correspond to features or elements shown in FIGS. 22–25 but differ therefrom are designated by the reference character thereof with a prime (') added; for example, top rail 27' corresponds to top rail 27, line 112' corresponds to line 112, and so on.

The embodiment shown in FIGS. 22–25 and the embodiment shown in FIGS. 26–29 operate on the same principles. Counterweights 51' have vertical bores and passages corresponding to those in counterweights 51. As shown in FIG. 26, the second bore in counterweight 51' is directly behind and in alignment with bore 114*b'*. The counterweights may be made of iron, steel, or lead.

In order to maximize the forces tending to keep horizontal the head edge of platform 40 and the foot edge of platform 40 in the embodiment shown in FIGS. 22–25, and to minimize the tendency of counterweight 51 to tilt, lines 112 and 114 should act on counterweight 51 at points which are spaced relatively far apart, as measured horizontally (i.e., as viewed in a top view); the same is true of lines 116 and 118. In contrast, lines 112 and 116 should act on counterweight 51 at points which are spaced relatively close together, as on at the same point viewed from the top; the same is true of lines 114 and 118. As viewed from the top, the distance between the points where lines 112 and 114 support counterweight 51 and the distance between the points where lines 116 and 118 do so should be greater than 12 inches, while the distance between the points where lines 112 and 116 support counterweight 51 and the distance between the points where lines 114 and 118 do so should be less than 12 inches.

Correspondingly, to avoid tilting of counterweights 51' in the embodiment shown in FIGS. 26–29, the two lines acting on a given counterweight 51' should do so at points which are relatively close together, as viewed from the top.

Since in the embodiment shown in FIGS. 26–29 there is no need to have a counterweight passage between platform side rail ends 44*e*, platform deck 46 may be extended toward the end of the bed over and between side rail ends 44*e* and out to the ends thereof, so that the profile of the extended deck portion lies on the rear edge of rear side rail end 44*e*, the front edge of front side rail end 44*e*, and an imaginary line extending between the ends of side rail ends 44*e*.

In another variation of the invention, which is not shown, one of the lines running from each platform side rail 44*e* can run downward, under a bottom rail extending between the bottoms of posts 12 and 14 which is similar to the top rail and has pulleys disposed in recesses therein, then laterally, and then back upward to the desired location at the bottom of the counterweight. This variation is not preferred, however, because: it does not achieve the desired redundant support; it increases the load on the platform-supporting lines and the pulleys on the top rail, which in turn increases the friction the pulleys must overcome to rotate; it increases the number of axles and the number of rails with pulleys; and it clutters the space beneath the counterweights and the platform.

It will be understood that while embodiments with two and four counterweights have been described, the line and pulley systems can be arranged so as to have only one counterweight, as disclosed in Glass U.S. Pat. No. 3,882,554. With an appropriate modification of the bed structure, as well as of the line and pulley system, such a counterweight could be disposed along the rear of the bed and comprise a hollow rectangular box containing ballast weights which may be handled separately during transportation and installation. Alternatively, two or more separate counterweights could be disposed along the rear of the bed, in alignment with each other. Eliminating the counterweights from the head and foot of the bed would free up the space required for their vertical travel; this would permit use of the space within the head and the foot below the movable platform in its lower, sleeping position and would allow a fluorescent light to be mounted on the bottom of the top rail or on the inner surface of an exterior cross-brace.

The variation of the bed shown in FIGS. 30–33 is similar to the embodiment shown in FIGS. 22–25, but the posts, such as front post 214, are angular rather than rectangular, and top rail 227 is a channel. The corner of the bed shown in FIG. 30 corresponds to the corner of the bed shown in the lower portion of FIG. 23.

Each post is made of two boards fastened together at their longitudinal edges at a 90 degree angle by conventional furniture-making techniques, and top rail 227 rests in rectangular recess 227*r* in each post and is fastened to the post by horizontal and vertical screws (not shown). For example, each post board may be 3.5 inches ×0.75 inches ×91 inches, and top rail 227 may be an aluminum extrusion having a cross-section of 1.75 inches (base, outside) ×1.0 inch (legs, outside) ×0.125 inch (wall thickness) and a length of 40.5 inches. (All lumber dimensions with respect to the embodiments shown in FIGS. 30–34 are actual dimensions rather than nominal dimensions.)

Rear rail 234 and front rail 236 (which has been removed for clarity in FIG. 31) extend to the tops of posts 212 and 214 and cover the ends of top rail 227. End rail 238 is coelevational with rear rail 234 and front rail 236 and abuts them. Rails 234, 236, and 238 are fastened to post 214 with carriage bolts or hex bolts (not shown). There are two carriage bolts at each joint to eliminate rotational tendencies. Nuts or hex bolt heads on the interior surfaces of the posts should be countersunk to avoid interference with platform side rail ends 244*e*. In addition, to provide further structural rigidity, vertical braces 237, which are only as long as the height dimension of the rails, are permanently attached to the rails by means (not shown) such as screws and/or glue and are fastened to the posts by carriage bolts or hex bolts (not shown). Of course, rails 234 and 236 extend to adjacent posts of the head of the bed and are fastened thereto in a similar manner. Rear rail 234 and front rail 236 may be boards 0.75 inches ×5.5 inches ×91.5 inches, end rail 238 may be a board 0.75 inches ×5.5 inches ×40.5 inches. Members 237 may be extruded aluminum angles having a cross-section of legs 0.75 inch long (outside) and 0.125 inch wall thickness and a length of 5.5 inches. Alternatively, these short vertical braces may be wood blocks.

Top rail 227 may be reinforced and supported by a longitudinal board (not shown) extending between it and end rail 238 and secured to them by means such as screws, carriage bolts, or hex bolts. This board could have dimensions of 1.0 inch ×1.0 inch ×32.5 inches. Alternatively, the channel constituting the top rail could be made of four boards 40.5 inches long glued and nailed together: a 1.5 inch ×1.5 inch board secured to end rail 238 to serve as one leg, a 0.75 inch ×1.5 inch board spaced about 1.25 inches therefrom to serve as the other leg, a 0.75 inch ×3.5 inch board secured to their bottom surfaces to serve as the base, and sections of a similar 0.75 inch ×3.5 inch board secured to their top surfaces so as to permit access to the pulleys from the top.

As best shown in FIGS. 30 and 33, support blocks 223 perform the supporting function of cross-braces 22 of the embodiment shown in FIG. 22. Each block 223 has length and width dimensions corresponding to the inner dimensions of the legs of the posts, with its exposed corner 223*c* being rounded off. Block 223, which may be made of wood, may extend all the way to the floor; alternatively, it may have a height of about 6 inches, as shown in FIG. 33. To provide for additional structural rigidity, one or more interior cross-braces (not shown) may be fastened to the support blocks on the front and rear posts so as to extend therebetween in a manner similar to interior cross-brace 22 of the embodiment shown in FIG. 22.

In principle, movable platform 240 is similar to platform 40 of the embodiment shown in FIG. 22, but its configuration and dimensions are different. In effect, the side rails have been spread apart, so that the front and rear edges of platform side rails 244 define the front and rear edges of platform 240. Also, bracket 210 has been substituted for U-bolt 110 shown in FIG. 24. Bracket 210 may be a 1-inch long section of the aluminum extrusion mentioned above as suitable for use in top rail 227. As viewed in FIG. 30, bracket 210 is directly beneath top rail 227 and hence is mostly obscured thereby. Alternatively, the bracket may be a 1-inch long section of a square tube 1.75 inches (outside) ×1.75 inches (outside) ×0.125 inches (wall thickness), with holes in its top surface for the lines to pass through.

Pulleys 28 are mounted on carriage bolts 202 passing through holes in the legs of top rail 227. Fender washers 203 are located on the bolts between pulleys 28 and at their side faces for the reasons stated earlier. The ropes extend downward through holes **227*h* in the base of top rail 227. Pulleys 66*c* and 66*d* and spacer 209 are mounted on carriage bolt 211 passing through holes in bracket 210. Lines 116 and 118, instead of being secured to top rail 227 by knots, are continuous, and at 117 pass over the top surface of the base of top rail 227**.

Counterweight 251 is similar to counterweight 51 of the embodiment shown in FIG. 22, except that it may be wider from front to back, since the space between side rail ends **244*e* is greater. For example, counterweight 251** may be 30.5 inches wide.

As best shown in FIGS. 32 and 33, there are no diagonal bracing members in this embodiment. This improves the appearance of the bed. In addition to rear rail 234, the rear bracing means comprises horizontal rear braces 232,233 fastened to panel 225 to provide a unitary structure. The relatively large area of panel 225 permits this structure to be thinner than X-braces 32 and 33 shown in FIG. 2, while also providing a surface which may be used as a bulletin board or decorated. Horizontal braces 232, 233 may be boards 0.75 inches ×3.5 inches ×91.5 inches. Panel 225 may be plywood 40 inches ×82 inches ×0.125 inch.

In the embodiment shown in FIG. 34, there is an unobstructed space 300 for relatively tall furniture or other articles to occupy permanently without ever interfering with the platform, irrespective of whether the platform is in the higher, stored position, the lower, sleeping position, or an intermediate position. This is accomplished by using longer end rail 338 extending to a far rear post 312, and substituting, for exterior cross-braces 16 and 18, longer cross-braces which are the same length as end rail 338. Horizontal rear braces 232, 233, still attached to panel 225, are attached to far rear post 312 and the corresponding far rear post at the head of the bed, as is rear rail 234. Intermediate longitudinal rail 239 extends between rear post 212 and the corresponding rear post at the head of the bed. The space under intermediate longitudinal rail 239, like the space under front rail 236, is unobstructed. Rail 239 may be a board 0.75 inch ×5.5 inches ×39.0 inches.

Space 300 is ideally suited for articles such as bookshelves, a PC monitor, a TV, audio equipment, a lamp, and the like. Such articles could be arranged so that some of them could be used normally when the movable platform is in the upper, stored position, yet also used by a person lying on the bed in the lower, sleeping position; for example, a clock, radio, or reading lamp could be kept on such bookshelves. The rear bracing means should be spaced 6 to 30 inches from the rear of the movable platform to accommodate such articles without unduly increasing the width of the bed. If one or more counterweights are disposed along the rear of the bed instead of at the head and foot, as described above, they could be located in front of, below, or behind rear rail 234, as viewed in FIG. 34; in this event top rail 227 and the lines could be extended rearward to a position above the counterweight(s), and the lines could then run along, or parallel to, rear rail 234, over pulleys located at the appropriate places, and then down to the counterweight(s).

Other typical dimensions of the embodiments shown in FIGS. 30–34 are as follows: length of platform deck—82 inches; width of platform deck—37.5 inches; length of platform side rails—87.75 inches; carriage bolts and hex bolts—0.25 inches; distance of platform travel—from 20 to 45 inches; distance of counterweight travel—from 60 to 90 inches.

While presently preferred embodiments of the invention have been illustrated and described, it will be understood that the invention is not limited thereto, but may be otherwise variously embodied within the scope of the following claims.

I claim:

1. A self-supporting bed comprising:

a longitudinal axis;

a head structure comprising a vertical front post, a vertical rear post, and bracing means fastened to each of said posts at vertically spaced locations thereon and extending between said posts in a plane perpendicular to said longitudinal axis, said head structure having bottom bearing surfaces suitable for supporting said head structure on a horizontal floor;

a foot structure comprising a vertical front post, a vertical rear post, and bracing means fastened to each of said posts at vertically spaced locations thereon and extending between said posts in a plane perpendicular to said longitudinal axis, said foot structure having bottom bearing surfaces suitable for supporting said foot structure on a horizontal floor, said bottom bearing surfaces being disposed in a common plane with said bottom bearing surfaces of said head structure;

rear bracing means fastened to each of said rear posts at vertically spaced locations thereon and extending in a plane parallel to said longitudinal axis;

a front rail fastened to each of said front posts of said head structure and said foot structure and extending therebetween in a direction parallel to the longitudinal axis of the bed, so that said head structure, said foot structure, said rear bracing means, and said front rail being spaced a sufficient distance above said plane of said bottom bearing surfaces to define, with said front posts, an unobstructed rectangular opening through which a person can walk without crouching or ducking;

pulley means secured in said frame including a plurality of pulleys secured to said head structure and a plurality of pulleys secured to said foot structure;

a rectangular platform which is suitable for supporting a mattress and is movable vertically within said frame between a lower, sleeping position and a higher, stored position in which said movable platform is spaced a sufficient distance above said plane of said bottom bearing surfaces that a person can walk through said rectangular opening and stand under said movable platform without crouching or ducking, said platform being horizontal in both said lower, sleeping position and said higher, stored position and having a front edge, a rear edge, a head edge, a foot edge, and four corners, each of which corners is proximate to one of said posts and beneath at least one of said pulleys;

a vertically movable counterweight connected to each of said corners of said platform by at least one line in tension extending upward from each of said corners to said pulley above each of said corners, over said pulley, and downward to said counterweight where it is connected at a location;

fist stationary support means fastened to said front and rear posts of said head structure;

second stationary support means fastened to said front and rear posts of said foot structure;

said first and second stationary support means being adapted to define said lower, sleeping position by limiting the downward travel of said platform and to support said platform in said position;

said pulley means and said lines being arranged and connected so that at each end of the bed a first line supports a front corner of said platform, a second line supports an adjacent rear corner of said platform, said first line also supports said counterweight, and said second line also supports said counterweight at the same location as where the counterweight is supported by said first line so that the raising of said front corner by a first distance with said lines in tension requires said counterweight to be lowered, which in turn causes said adjacent rear corner to be raised by a second distance which is equal to the first distance, and so that the lowering of said front corner by a first distance causes said counterweight to be raised, which in turn causes said adjacent rear corner to be lowered by a distance which is equal to the first distance, with the result that said adjacent front and rear corners must remain in horizontal alignment with each other during raising and lowering of the platform.

2. A bed according to claim 1 wherein said front rail, and said platform, when it is in said higher, stored position, are spaced at least 60 inches above said plane of said bottom bearing surfaces.

3. A bed according to claim 1 wherein said first stationary support means and said second stationary support means remain fastened to said posts when said platform is in said higher, stored position as well as when said platform is in said lower, sleeping position.

4. A bed according to claim 1 wherein said rigid, stationary frame and said platform are dimensioned so as to result in clearances therebetween which are sufficient to reduce the possibility of binding against each other during vertical movement of said platform, yet are insufficient to allow said platform, when moved all the way toward said head structure or said foot structure, or all the way to the rear or front, or fully rotated clockwise or counterclockwise in a horizontal plane, either to slip off said first stationary support means or said second stationary support means or to interfere with any of said bracing means during said vertical movement.

5. A bed according to claim 1 wherein in said higher, stored position said platform is suspended from said pulley means.

6. A bed according to claim 1 wherein there are two of said counterweights, each of which moves within a passage defined by interior vertical surfaces of the posts of said head structure and interior vertical surfaces of the posts of said foot structure when said platform is moved between said lower, sleeping position and said higher, stored position.

7. A bed according to claim 6 wherein each of said counterweights passes through a passage in said platform when said platform is moved between said lower, sleeping position and said higher, stored position.

8. A bed according to claim 1 wherein in said lower, sleeping position the rear of said platform is engaged and restrained from upward vertical movement by a stationary keeper on said stationary frame, and wherein in operation a portion of said platform is moved under, and locked under, said keeper by rearward movement of the entire said platform, which can be effected by a user standing at the front of said platform.

9. A bed according to claim 8 wherein in said lower, sleeping position the front of said platform is restrained from upward movement by movable latching means.

10. A bed according to claim 9 wherein said latching means is a hook engageable with said platform.

11. A bed according to claim 10 wherein said hook is rotatable into a recess in said platform.

12. A bed according to claim 1 wherein said first stationary support means is a horizontal cross-brace extending between said front and rear posts of said head structure and said second stationary support means is a horizontal cross-brace extending between said front and rear posts of said foot structure.

13. A bed according to claim 1 further comprising a mattress carried on said platform, which mattress, when said platform is in said stored position, extends above at least a portion of said front rail.

14. A bed according to claim 1 wherein said counterweight is a hollow rectangular box containing ballast whose weight may be varied so as to balance the sum of the weights of said movable platform and any mattress, sheets, blankets, pillow, and other bedding carried thereby.

15. A bed according to claim 1 wherein further pulleys are secured to said platform and at least one of said lines secured to said head or foot structure extends downward to said platform, under one of said further pulleys, upward from said platform, over one of said pulleys secured to said structure, and then downward to said counterweight, whereby said counterweight has a mechanical advantage with respect to said platform.

16. A bed according to claim 15 wherein said mechanical advantage is 2:1 and, when said platform is moved from said lower, sleeping position to said higher, stored position or vice versa, said platform travels a distance of from 30 to 45 inches while said counterweight travels a distance of from 60 to 90 inches.

17. A bed according to claim 1 wherein said platform is spaced from 6 to 30 inches from said rear bracing means, so as to provide unobstructed space for relatively tall furniture or other articles to occupy permanently without interfering with said platform, irrespective of whether said platform is in the higher, stored position or the lower, sleeping position or an intermediate position.

18. A bed according to claim 1 wherein there are two lines connected to a first corner of said platform, one of said lines being connected to a counterweight at a first location and the other of said lines being connected to said counterweight at a second location spaced from said first location, and wherein there are two lines connected to a second corner of said platform which is adjacent to said first corner, one of said lines connected to said second corner being connected to said counterweight either at said first location or nearer thereto than to said second location, and the other of said lines connected to said second corner being connected to said counterweight at said second location or nearer thereto than to said first location.

19. A bed according to claim 18 wherein said four lines redundantly support said platform so that if one line breaks, neither of said corners will fall, yet the break will be evident during subsequent raising or lowering of said platform because the broken line will no longer provide a force tending to keep said head edge of said platform and said foot edge of said platform horizontal.

20. A bed according to claim 11 wherein said lines redundantly support said platform so that if one line breaks, neither of said corners will fall, yet the break will be evident during subsequent raising or lowering of said platform because the broken line will no longer provide a force tending to keep said head edge of said platform and said foot edge of said platform horizontal.

21. A bed according to claim 1 wherein said first and second lines support said counterweight at a corner thereof.

22. A bed according to claim 1 wherein said counterweight remains horizontal during raising and lowering of said platform.

23. A bed according to claim 1 wherein said platform is spaced from said frame a sufficient distance to provide unobstructed space for relatively tall furniture or other articles to occupy permanently without interfering with said platform, irrespective to whether said platform is in the higher, stored position or the lower, sleeping position or an intermediate position.

24. A bed according to claim 1 wherein additional pulleys are fixed to said platform and said lines pass under said additional pulleys, thereby providing said counterweight with a mechanical advantage with respect to said platform, so that when said adjacent corners are raised by a first distance, said location on said counterweight is lowered by a second distance which is greater than said first distance, and so that when said adjacent corners are lowered by a first distance, said location on said counterweight is raised by a second distance which is greater than said first distance.

25. A bed according to claim 24 wherein said mechanical advantage is 2:1 and said second distance is twice said first distance.

26. A bed according to claim 1 wherein said raising and lowering of said platform with the head edges and foot edges thereof horizontal can be effected by a user standing at, and manually applying a vertical force to, the front of said platform.

* * * * *